US010084231B2

(12) United States Patent
Emerick et al.

(10) Patent No.: US 10,084,231 B2
(45) Date of Patent: Sep. 25, 2018

(54) LOW THERMAL IMPEDANCE STRUCTURE IN A PHASED ARRAY

(71) Applicant: Blue Danube Systems, Inc., Warren, NJ (US)

(72) Inventors: James Emerick, Briarcliff Manor, NY (US); Robert M. Honeycutt, Galax, VA (US); Josef Ocenasek, Whippany, NJ (US)

(73) Assignee: Blue Danube Systems, Inc., Warren, NJ (US)

( * ) Notice: Subject to any disclaimer, the term of this patent is extended or adjusted under 35 U.S.C. 154(b) by 38 days.

(21) Appl. No.: 15/393,730

(22) Filed: Dec. 29, 2016

(65) Prior Publication Data

US 2017/0187105 A1 Jun. 29, 2017

Related U.S. Application Data

(60) Provisional application No. 62/272,201, filed on Dec. 29, 2015.

(51) Int. Cl.

| | |
|---|---|
| ***H01Q 1/38*** | (2006.01) |
| ***H01Q 1/42*** | (2006.01) |
| ***H01Q 5/335*** | (2015.01) |
| ***H01Q 21/22*** | (2006.01) |
| ***H01Q 1/22*** | (2006.01) |
| ***H01Q 1/48*** | (2006.01) |

(52) U.S. Cl.

CPC ..... *H01Q 1/42* (2013.01); *H01Q 1/2291* (2013.01); *H01Q 1/38* (2013.01); *H01Q 1/48* (2013.01); *H01Q 5/335* (2015.01); *H01Q 21/22* (2013.01)

(58) Field of Classification Search

CPC ..... H01Q 1/2291; H01Q 1/38; H01Q 1/42; H01Q 1/48; H01Q 21/22; H01Q 5/335

See application file for complete search history.

(56) References Cited

U.S. PATENT DOCUMENTS 2,942,856 A * 6/1960 Woodward ..... H05K 7/20009 165/144

3,549,949 A * 12/1970 Granberry ..... H01Q 1/02 165/80.4

(Continued)

FOREIGN PATENT DOCUMENTS

EP 2549589 1/2013

*Primary Examiner* — Tho G Phan

(74) *Attorney, Agent, or Firm* — Occhiuti & Rohlicek LLP

(57) ABSTRACT

An antenna system including: a metal base plate; an antenna element arranged on and extending away from the front side of the base plate; a circuit board including a ground plane, adjacent to, and in thermal contact with the base plate; a plurality of electrical components on the circuit board including a power amplifier and an I/O connector; a metal support plate separated from, parallel to, and facing the base plate, with the circuit board located between the base and support plates; a plurality of thermally conductive standoffs thermally connecting the base plate to the support plate; and a master board including an I/O connector mating with the I/O connector on the circuit board and electrically connecting the circuit board to the master board, the master board located between the circuit board and the support plate and including signal paths for routing signals to the circuit board.

29 Claims, 36 Drawing Sheets

(56) References Cited

U.S. PATENT DOCUMENTS

| | | | | |
|---|---|---|---|---|
| 4,353,072 | A * | 10/1982 | Monser | H01Q 13/0275 343/725 |
| 4,771,294 | A * | 9/1988 | Wasilousky | H01L 23/66 174/16.3 |
| 5,099,254 | A | 3/1992 | Tsukii et al. | |
| 7,129,908 | B2 * | 10/2006 | Edward | H01Q 1/02 343/878 |
| 7,417,598 | B2 * | 8/2008 | Navarro | H01Q 21/061 342/368 |
| 8,279,131 | B2 * | 10/2012 | Puzella | H01Q 1/02 343/700 MS |
| 8,537,059 | B2 * | 9/2013 | Sauer | H01Q 1/02 343/705 |
| 9,350,062 | B2 * | 5/2016 | Ostergaard | H01P 3/081 |
| 2010/0246130 | A1 | 9/2010 | Paquette et al. | |
| 2012/0162922 | A1 | 6/2012 | Cheyne et al. | |
| 2015/0015453 | A1 | 1/2015 | Puzella et al. | |

* cited by examiner

A-A'

7-2

21-1

C-C'
21-2

LOW THERMAL IMPEDANCE STRUCTURE IN A PHASED ARRAY

This application claims the benefit under 35 U.S.C. 119(e) of Provisional Application Ser. No. 62/272,201, filed Dec. 29, 2015, entitled "A Low Thermal Impedance Structure in a Phased Array," the entire contents of which are incorporated herein by reference.

FIELD OF THE INVENTION

The present disclosure relates generally to phased arrays such as are used in cellular or wireless local area networks and, more particularly, to thermal management of such phased arrays.

BACKGROUND

Phased arrays create beamed radiation patterns in free space to allow the formation of selective communication channels. A phased array is formed by placing a plurality of antennas in a grid pattern on a planar surface where these antennas are typically spaced ½ of the wavelength of the radio frequency (RF) signal from one another. The phased array can generate radiation patterns in preferred directions by adjusting the phase and amplitude of the RF signals being applied to each of the antennas. The emitted wireless RF signals can be reinforced in particular directions and suppressed in other directions by means of these adjustments. Similarly, phased arrays can be used to enhance the reception of wireless RF signals from preferred directions of free space while suppressing wireless RF signals arriving from other directions. The incoming RF signals, after being captured by the phased array, are phase and amplitude adjusted and combined to reinforce RF signals received from desired regions of free space and suppress RF signals that were received from undesired regions of free space. The wireless beam is steered electronically to send and receive a communication channel, thereby eliminating the need to adjust the position or direction of the antennas mechanically.

A phased array requires the orchestration of the plurality of antennas forming the array to perform in unison. A corporate feed network provides the timing to the phased array by delivering identical copies of an RF signal to each of the plurality of antennas forming the phased array. A uniform placement of the plurality of antennas over a planar area defines the phased array as having a planar surface area that extends over several wavelengths of the carrier frequency of the RF signal in both of the X and Y directions. For example, a phased array with 100 antennas arranged in a square planar area would have edge dimension equal to 5 wavelengths of the RF carrier frequency in each direction.

Power amplifiers (PA), which are packaged in discrete packages or integrated circuit components, amplify a transmit signal before the signal is coupled to the antenna. The power amplifier (PA) is fabricated in a semiconductor chip. The chip is then packaged and mounted onto a printed wire board (PWB) within the system. The circuit board for the PA is a PWB includes of one or more metal sheets laminated between electrically non-conductive layers of laminate. Some metal sheets are patterned to form a wiring interconnect network that electrically connects the terminals of integrated circuit components and other discrete components together as would be depicted on a corresponding circuit schematic. Other metal sheets can be used as heat spreaders to laterally spread out the heat along the plane of the circuit board. The integrated circuit components can be packaged and soldered to one of the surfaces of the PWB or surfaced mounted to the PWB as bare die and then either wire bonded or solder bumped to that surface of the PWB.

The power amplifiers of the phased array are designed to handle signals with large peak-to-average power ratio (PAPR). Such a PA would be designed to perform linearly at the peak power ration; however, doing so causes the PA to be less power efficient when the signal has an average power ratio. The occurrence of the peak power ratio is typically an infrequent event; therefore, in order to insure that the PA operates linearly at all times, the PA ends up generating large dissipative heat losses when the signal has an average power ratio. A single PA can generate 25 W or more of heat. A phased array with 100 antennas can generate as much as 2500 W. For comparison, the PA of current base stations driving a single antenna dissipates only 100's of watts.

The antennas and the electrical components of the phased array are placed in a sealed environment to protect the antennas from the weather conditions of rain, snow, etc. However, the sealed environment that is used to protect the antennas and electrical components also prevents the removal of heat generated from the PWB where the antennas are mounted. This can case problems due to overheating of the phase array system.

SUMMARY

In general, in one aspect, the invention features an antenna system including: an antenna module including: a thermally conductive base plate with front and back sides; a plurality of thermally conductive standoffs; an antenna element arranged on and extending away from the front side of the base plate; a circuit board with front and back sides and including a ground plane on the back side of the circuit board, the ground plane of the circuit board next to and in thermal contact with the back side of the base plate; a plurality of electrical components mounted on the circuit board, the plurality of electrical components including an I/O connector, and a power amplifier in thermal contact with the base plate, the power amplifier for driving the antenna element with a transmit signal. The antenna system further includes: a thermally conductive support plate with front and back sides, the front side of the support plate separated from, parallel to, and facing the front side of the base plate, and wherein the circuit board is located between the base plate and the support plate; and a master board including an I/O connector mating with the I/O connector on the circuit board and electrically connecting the circuit board to the master board, said master board located between the circuit board and the front side of the support plate, the master board including signal paths for routing signals to the circuit board, and wherein the plurality of thermally conductive standoffs thermally connect the base plate to the support plate.

Other embodiments include one or more of the following features. The power amplifier is mounted directly on the base plate or alternatively directly on the circuit board. The base plate and the support plate are made of metal. The antenna system also includes a heat sink assembly thermally connected to the support plate, the heat sink assembly that includes a plurality of metal fins for convectively dissipating heat generated by the circuit board. The master board has a plurality of holes through which the plurality of standoffs pass to thereby thermally connect the base plate to the support plate. The antenna system further includes a heat conducting material sandwiched between the back surface of the circuit board and the back surface of the base plate. The heat conducting material is a thermally conductive gasket.

The signal paths on the master board are for routing IF and local oscillator signals to the circuit board. The antenna system also includes an RF transparent radome covering and protecting the antenna module and the master board. The master board includes only passive electrical components. The master board is mounted on the support plate. The circuit board and the master board are printed wire boards.

In general, in another aspect the invention features an antenna system including: a plurality of antenna modules; a thermally conductive support plate; a master board on the support plate, the master board including signal paths for routing signals to the plurality of antenna modules and including a plurality of I/O connectors, wherein the plurality of antenna modules are electrically connected to the master board, and wherein each antenna module of the plurality of antenna modules includes: a thermally conductive base plate with front and back sides; a plurality of thermally conductive standoffs; an antenna element arranged on and extending away from the front side of the base plate; a circuit board with front and back sides and including a ground plane on the back side of the circuit board, the ground plane of the circuit board next to and in thermal contact with the back side of the base plate; a plurality of electrical components mounted on the circuit board, the plurality of electrical components including an I/O connector; and a power amplifier in thermal contact with the base plate, the power amplifier for driving the antenna element with a transmit signal. The plurality of thermally conductive standoffs thermally connect the base plates of the antenna modules to the support plate.

DETAILED DESCRIPTION

Figure 1:
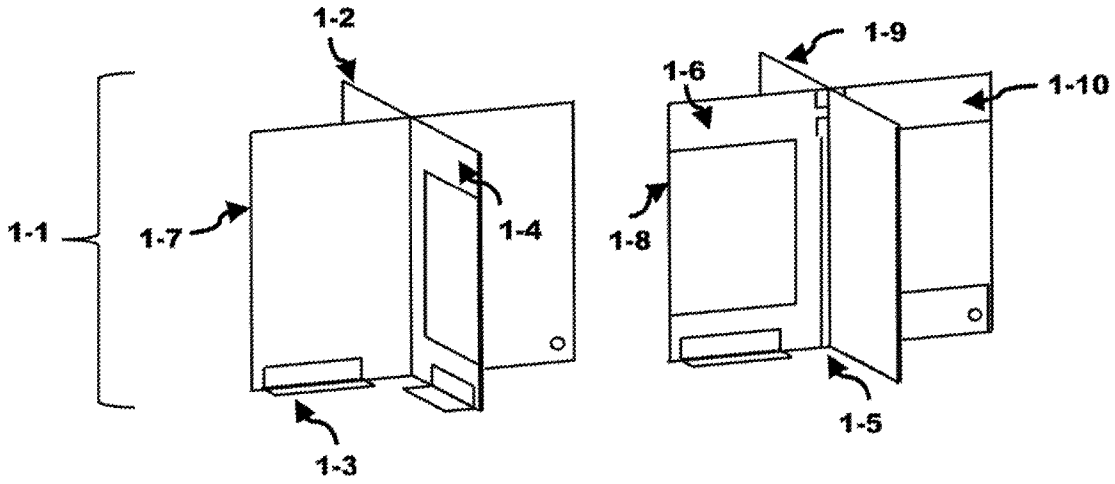
FIG. 1 illustrates a perspective view of two instances of a cross pole antenna.

FIG. 1 illustrates a perspective view of two instances of cross pole antennas 1-1. Each cross pole antenna includes two dipole antennas that are orthogonal to one another. For example, the dipole antenna on segment 1-2 is orthogonal to the dipole antenna that is on segment 1-7. One half of the dipole antenna 1-4 is illustrated on segment 1-2. The dipole antenna on segment 1-7 is not visible from this perspective since the dipole is on the backside of 1-7. The right cross pole antenna includes the segments 1-8 and 1-9 which are orthogonal to one another. The dipole is visible on segment 1-8 as the "C" shaped patterns 1-6 and 1-10. An antenna lead 1-5 positioned at the bottom intersection of segments 1-8 and 1-9 drives the cross pole antenna. A similar antenna lead is positioned in a similar location for the left cross pole antenna. Mounting brackets 1-3 are used to mount the cross pole antennas to the surface of a ground plane. The front view shows the dipole antennas 1-6 and 1-10, which are fabricated from metal layers patterned on the surface of the circuit board for the antenna segment 1-8. It should be understood that any suitable antenna, dipole, patch, microstrip, or otherwise, functioning to transmit or receive RF signals, now known or hereafter developed, may be used for such an antenna.

Figure 2:
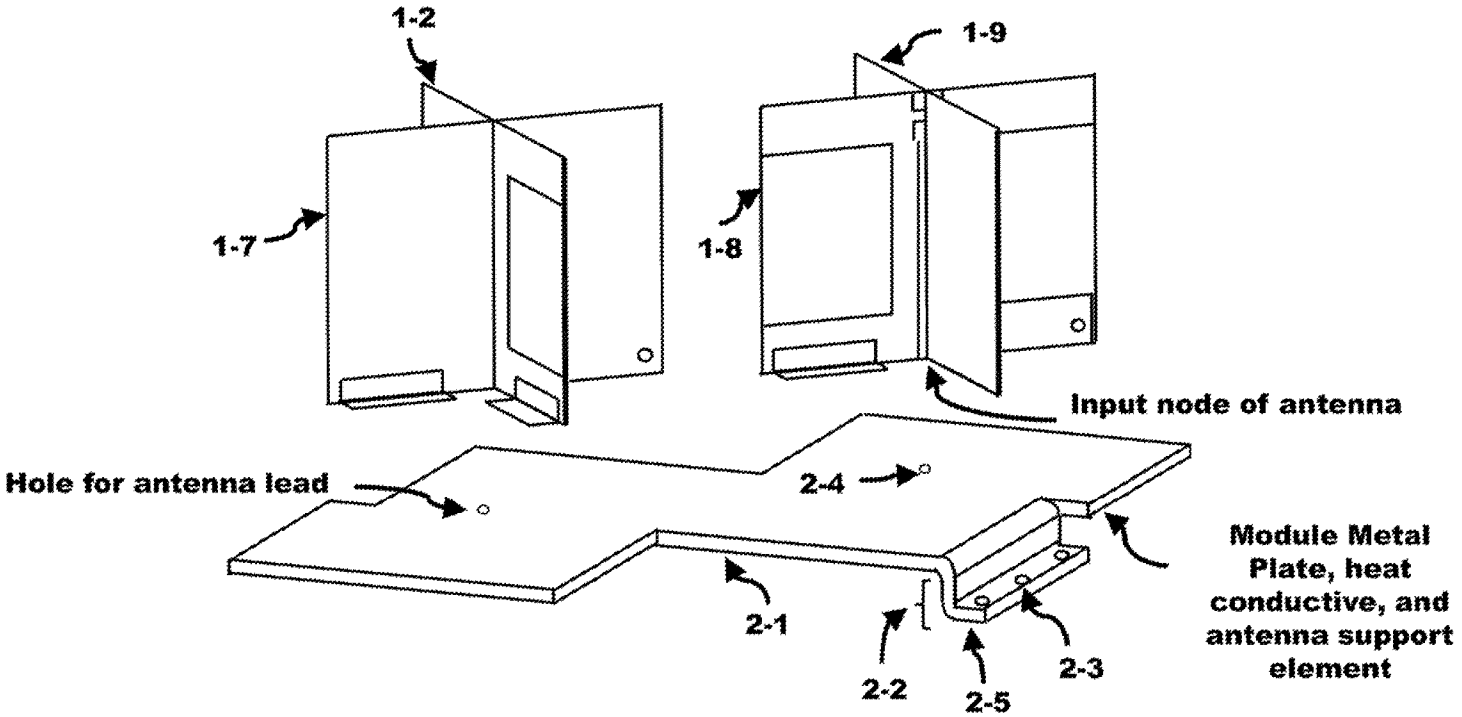
FIG. 2 depicts the cross pole antennas orientated over a Module Ground Plane with a dogleg.

FIG. 2 presents a perspective view of the module metal plate 2-1 in relation to the cross pole antennas. The module metal plate has at least one module standoff 2-2 and corresponding module foot 2-5. The module standoff and module foot forms a dogleg. The module foot has a set of holes 2-3 that are used for mounting purposes. The module metal plate also contains holes 2-4 for electrical leads connecting front-end circuitry to the antenna lead. The hole 2-4 is aligned with the input node of one of the dipole antennas of the cross pole antenna that corresponds to the antenna on segment 1-8. The hole for the orthogonal dipole antenna of the cross pole antenna corresponding to the antenna on segment 1-9 is not illustrated to simplify the diagram. Similarly, the "hole for the antenna lead" is aligned with the input node of one of the dipole antennas of the cross pole antenna that corresponds to the antenna on segment 1-7. The hole for the orthogonal dipole antenna of this cross pole antenna corresponding to the antenna on segment 1-2 is not illustrated to simplify the diagram. A hole is typically associated with each one of the antennas. A plurality of antennas requires a corresponding plurality of holes in the module metal plate.

The module metal plate is aluminum with a thickness of about 3.1 mm, although other metals are suitable as alternatives. Examples of metals with large thermal conductivity include but are not limited to copper, silver, zinc, nickel, iron, etc. In addition, metal alloys can also be used in the construction of the system. The dogleg can be formed by sequentially bending the metal tips of the module metal plate. The first bend creates the standoff portion, then a second bend at the tip of the standoff portion forms a foot. The dogleg structure of the standoff and foot can also be implemented as a separate metal component forming the dogleg that is then attached to the module metal plate by a combination of fastener means such as screws, nuts and bolts, conductive cement, etc.

Figure 3:
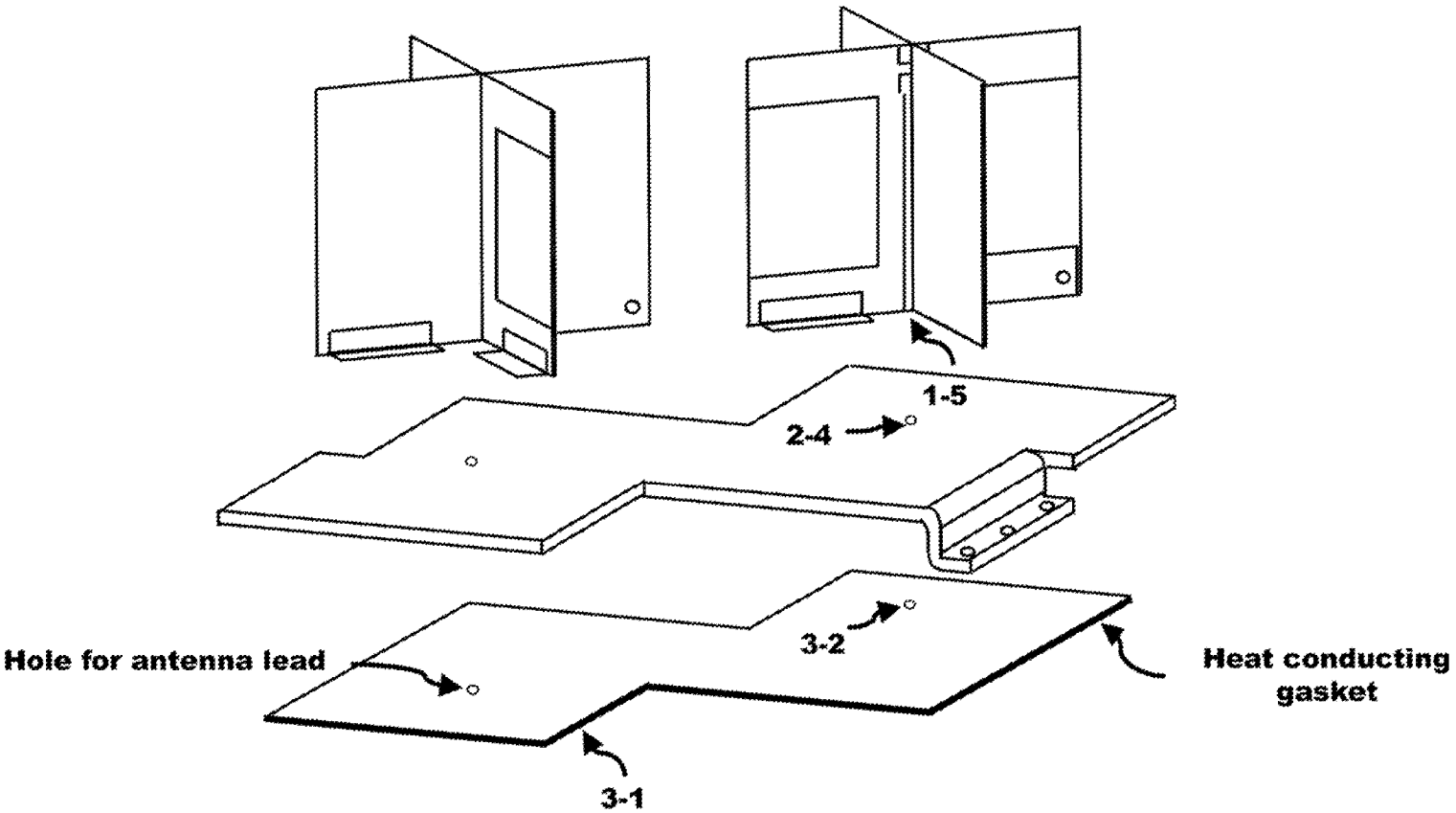
FIG. 3 shows a heat conducting gasket positioned below the Module Ground Plane.

FIG. 3 presents a perspective view of a heat-conducting gasket 3-1 in relation to the module metal plate. The surface of the gasket has two holes 3-2 which align with the holes 2-4 in the module metal plate and with the antenna lead 1-5 of the cross pole antennas. In some embodiments, the gasket can be replaced with paste, adhesive, or metallic glue, etc. or connected by fasteners (screws, bolts, etc.) to hold the two pieces together. The gasket can have electrical characteristics that are either conducting or insulating. The gasket is also optional.

Figure 4:
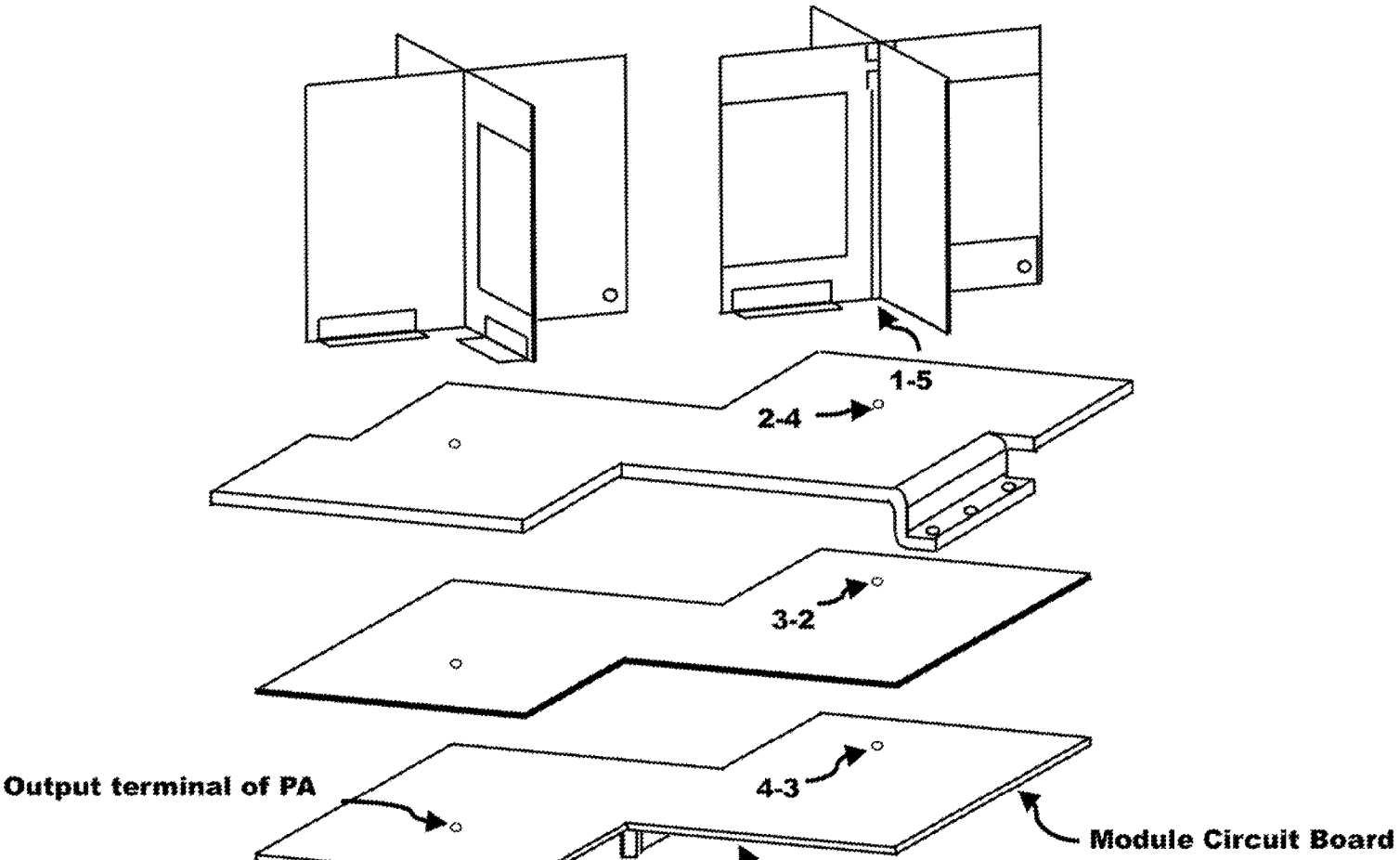
FIG. 4 depicts a module circuit board positioned below the heat conducting gasket.

FIG. 4 depicts a perspective view of the module circuit board 4-1 in relation to the gasket, module metal plate, and the cross pole antennas. The module circuit board 4-1 is a multilayered PWB board with integrated circuits, other discrete components, and an I/O connector 4-2 mounted thereon. At least one power amplifier (PA) used to drive the cross pole antenna is mounted on the module circuit board. The output lead of the PA can be accessed on the module circuit board at location 4-3. Note that the access point of the PA 4-3 is aligned with the hole 3-2, hole 2-4, and the antenna lead 1-5. The multilayer PWB board has one or more metal sheets on and possibly also within the PWB that serve at least two purposes: first, as a ground plane that extends over the area of the PWB, and second, as heat spreader to laterally transfer heat generated by the electrical components mounted on the PWB.

Figure 5:
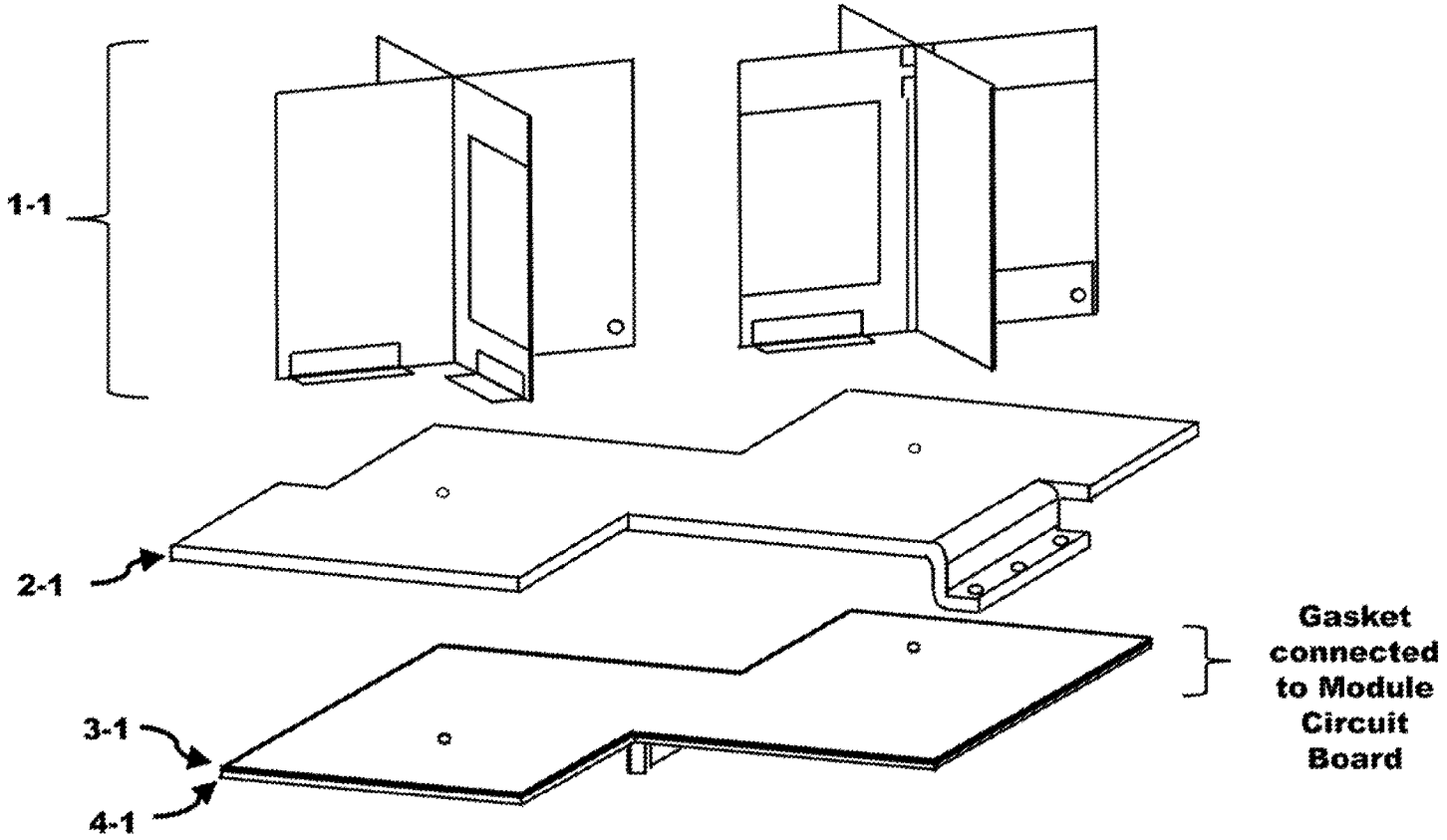
FIG. 5 presents the module circuit board and heat conducting gasket connected together.
Figure 6:
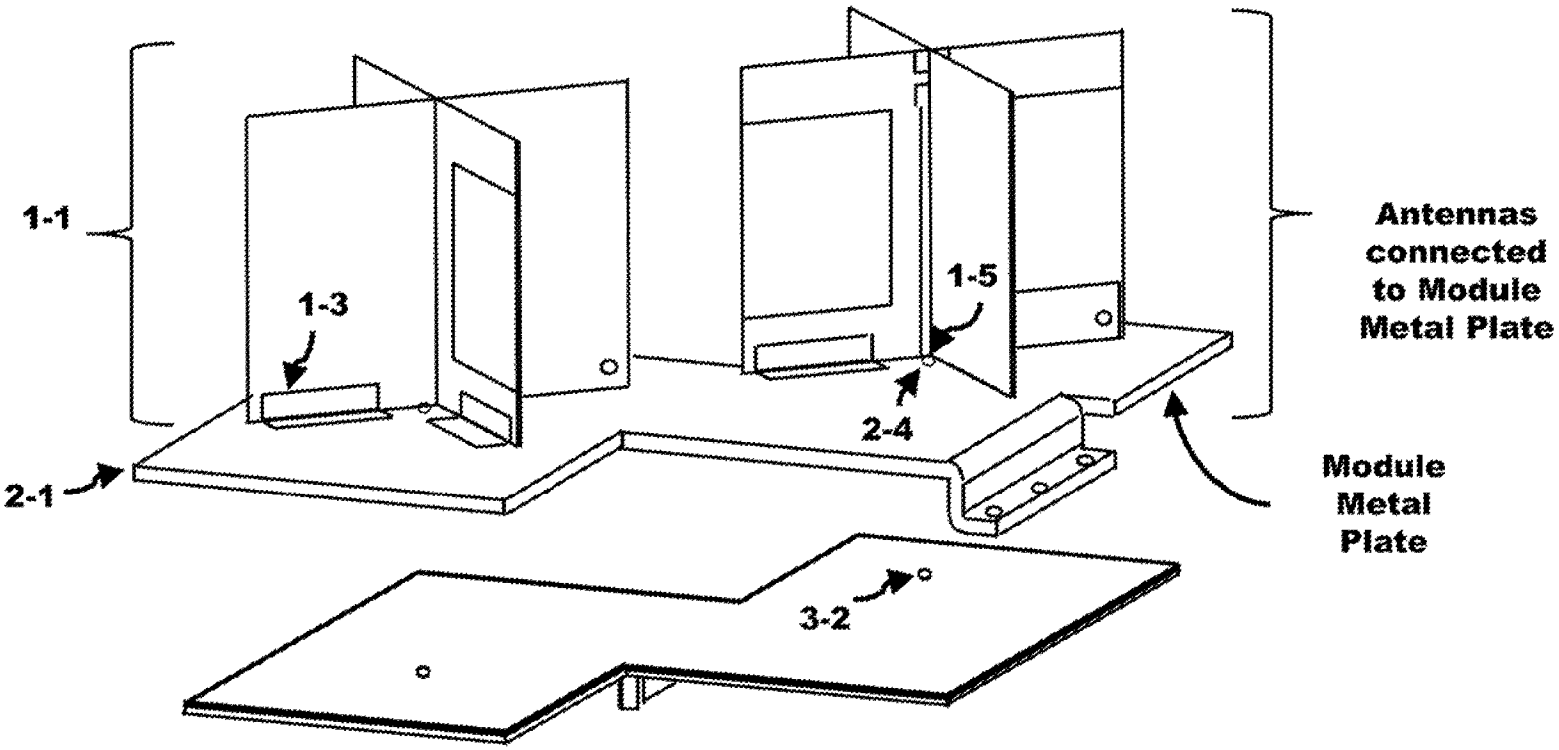
FIG. 6 illustrates the cross pole antennas connected to the Module Ground Plane.

FIG. 5 illustrates the bottom of the gasket 3-1 on the top surface of the circuit board 4-1. FIG. 6 illustrates the attachment of the cross pole antennas 1-1 to the module metal plate 2-1 presenting four dipole antennas attached to the module metal plate 2-1. However, other implementations are not limited to this particular configuration or number of antennas. Various embodiments include one or more antennas attached to the module metal plate. Any two antennas can be arranged orthogonally, in parallel, or in any orientation with respect to each other. The mounting brackets 1-3 connect the antennas to the module metal plate with attachments. Note the alignment of the antenna lead 1-5 with the hole 2-4 in the module metal plate 2-1 and the hole 3-2 in the gasket are aligned. Other embodiments can eliminate the gasket altogether. Instead the ground plane metal of the PWB can be contacted to the module metal plate contact directly using fasteners (screws, bolts, etc.) to hold the two pieces together, or with the use of a paste, adhesive, or metallic glue, etc.

Figure 7:
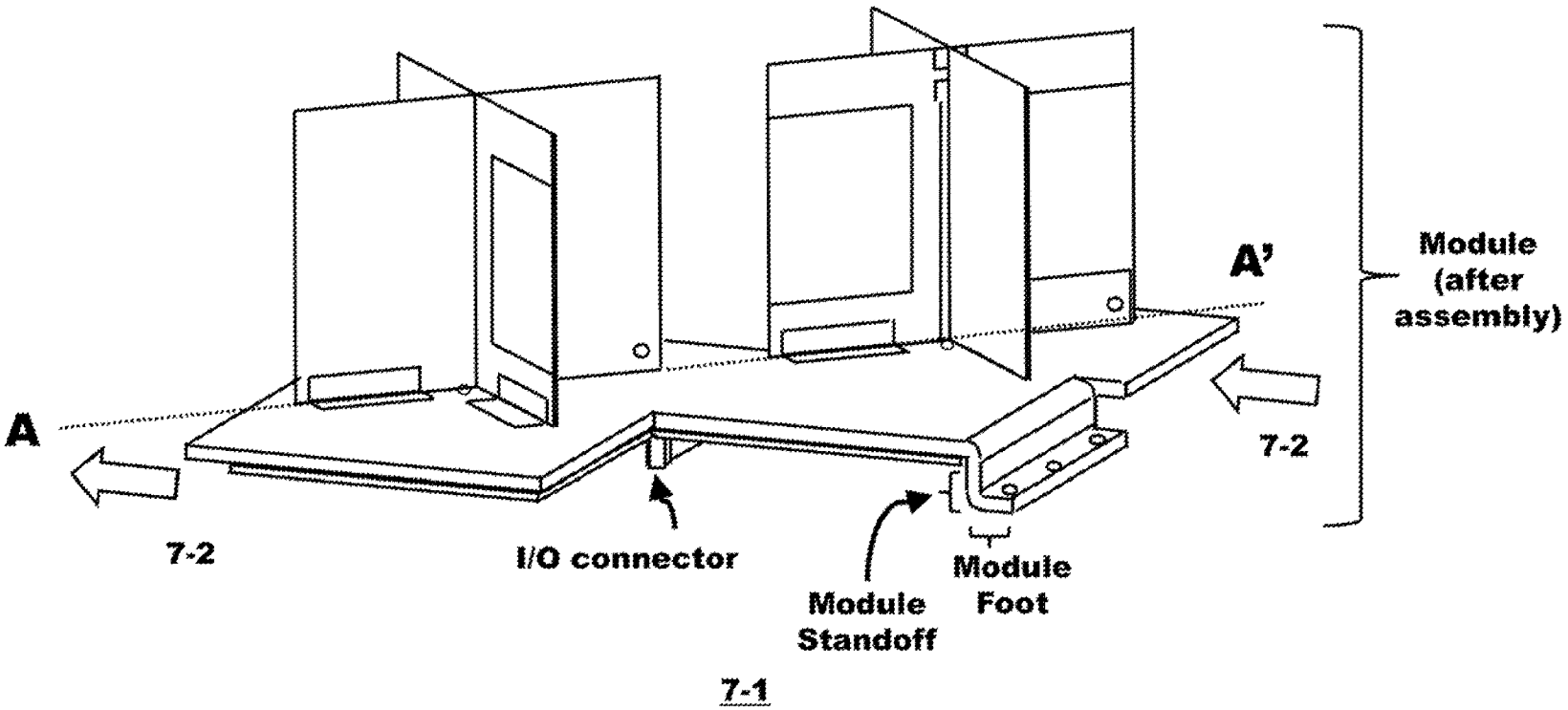
FIG. 7 illustrates four components: cross pole antennas; Module Ground Plane; heat conducting gasket; and module circuit board connected together forming a module.

FIG. 7 depicts the complete module 7-1 after attaching the top surface of the gasket to the bottom surface of the module metal plate. The gasket can electrically isolate the module circuit board from the module metal plate. However, the gasket has a high thermal coefficient and effectively transfers heat generated by the circuit components on the circuit (particularly the PA) to the module metal plate. The module after assembly comprises the two cross pole antennas, at least one module standoff and module foot, and at least one I/O connector. The module 7-1 is used as a building block to construct the phased array. FIG. 7 illustrates one example of a module for a phased array. For a description of other forms of module designs and information on the assembly, electrical and structural characteristics of the module and other components of the module phased array, please refer to U.S. Prov. Pat. App. No. 62/195,456, entitled "Modular Phased Array," filed on Jul. 22, 2015, the contents of which are incorporated herein by reference in their entirety. A view 7-2 along the perpendicular plane containing A-A' is presented in the FIG. 8.

Figure 8:
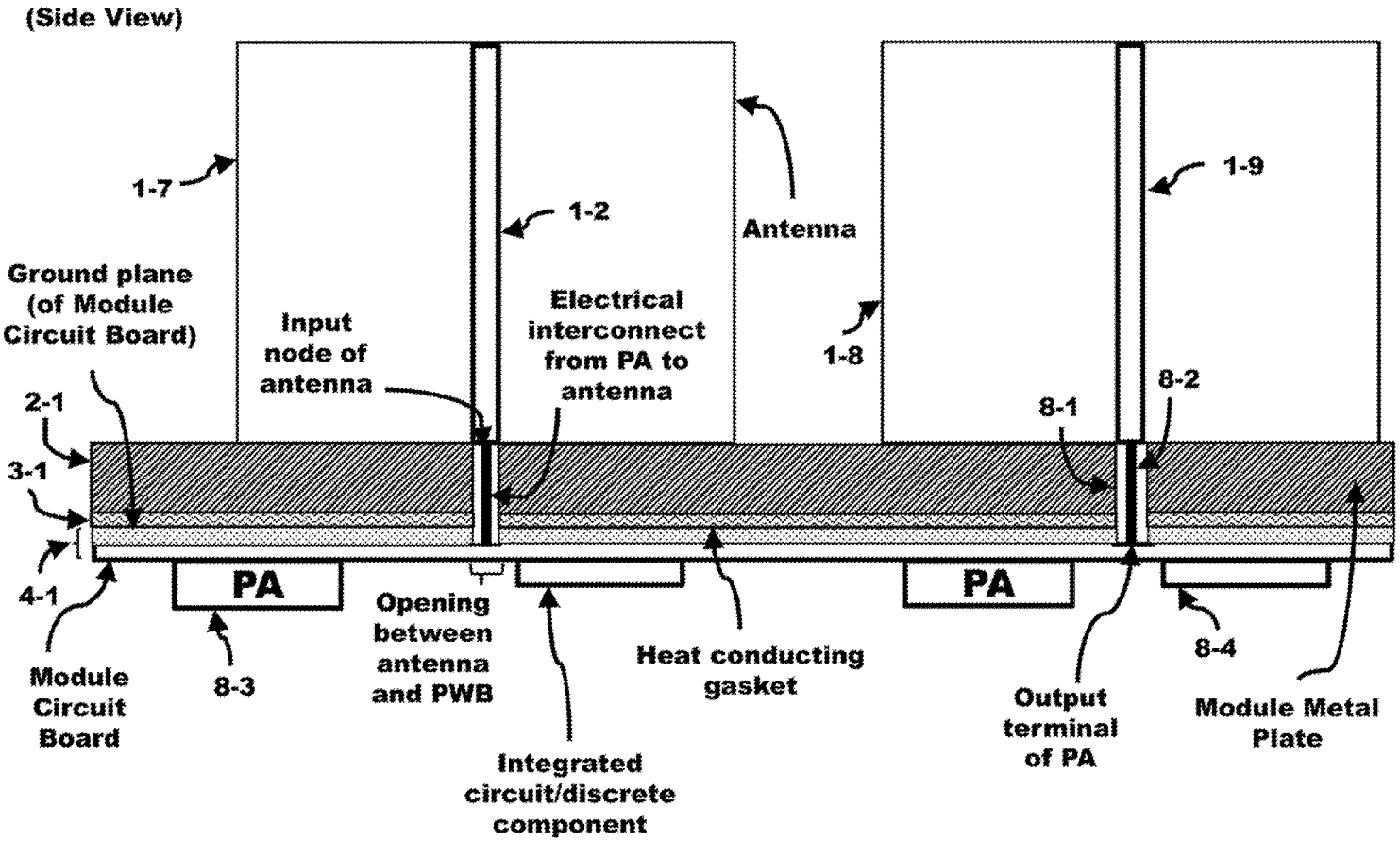
FIG. 8 depicts a cross-sectional view along the perpendicular plane containing A-A' of FIG. 7.

FIG. 8 illustrates the cross-sectional side view 7-2 of the module in a perpendicular plane including A-A'. The right cross pole antenna including the segments 1-8 and 1-9 is aligned at the intersection of the segments over the hole 8-1. The completed hole 8-1 consists of the alignment of the hole 2-4 in the module metal plate 2-1, the hole 3-2 in gasket 3-1, and the hole in the module circuit board 4-1 corresponding to the output lead 4-3 of the PA. The hole 8-1 creates an opening between the lead of the antenna located on one side of the module metal plate and the output lead of the PA that is mounted on the PWB located on the other side of the module metal plate. A metallic interconnect 8-2, surrounded by an insulting dielectric cover or simply bare, is used to connect the output lead of the PA to the input lead of the antenna. The wire and hole have appropriate dimensions to create a coaxial electric interconnect characterized with an impedance of approximately 50 ohms. In one embodiment, the metallic interconnect is soldered to the lead on the top surface of the PWB, the other end of the metallic interconnect is soldered to the lead of the antenna. Other methods of connecting the metallic interconnect at one or both ends are available that would be suitable as alternative embodiments. Examples are crimp-on connectors, plug and socket connectors, blade connectors, etc.

Some or all of the electrical components associated with the PWB's within the phased array is shielded using an RF shield. The electrical system of the phased array (antennas, PA output leads) produces a large amount of electromagnetic radiation that may be picked up by nearby electrical components. An RF shield is a metallic cover positioned near these electrical components to isolate these components from the stray electromagnetic radiation. The RF shield attempts to form an enclosed environment for the electrical components. The RF shield blocks the electromagnetic radiation from interfering with the normal operation of these enclosed electrical components.

The left cross pole antenna comprising of the segments 1-7 and 1-2 is electrically coupled to the module circuit board 4-1 in a similar manner. The module circuit board 4-1 has an exposed copper layer in contact with the gasket 3-1. On the opposite side of the circuit board, the surface is populated with at least one PA 8-3, integrated circuits 8-4, discrete components, and at least one I/O connector (not illustrated). The gasket is a flexible material and helps to compensate for any non-uniform height variations on the ground plane side of the fabricated PWB caused by manufacturing steps due to through holes and such. Other embodiments can eliminate the gasket altogether. Instead, the ground plane metal of the PWB contacts the module metal plate directly using fasteners (screws, bolts, etc.) to hold the two pieces together, or by the use of a paste, adhesive, or metallic glue, etc.

In another embodiment, the PA is attached directly (not illustrated) to the module metal plate 2-1. In one embodiment, the PWB has an opening where the integrated circuit of the PA can be inserted and attached directly to the module metal plate. The heat generated by the PA would conduct the heat through the integrated circuit to the module metal plate. The integrated circuit of the PA is glued to the module metal plate using a heat conducting glue or paste. Wire bonds or a tab attachment couple electrical signals between the PWB and the input/output pads of the PA. An output terminal of the PA is connected to the antenna via the hole 8-1.

Figure 9:
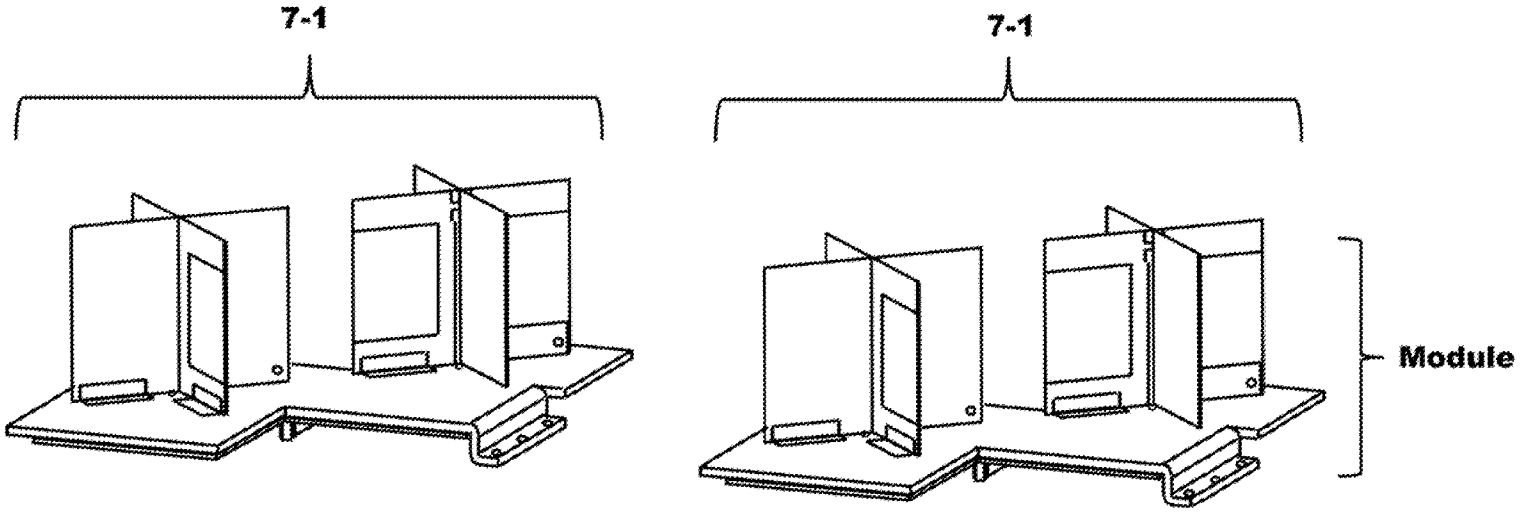
FIG. 9 depicts two instances of a module.
Figure 10:
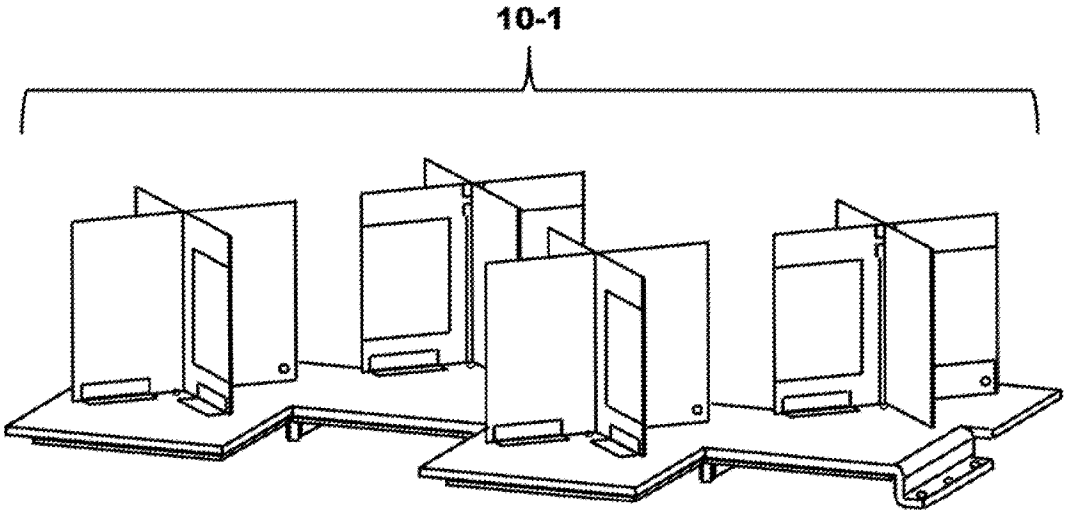
FIG. 10 shows the two instances of the modules coupled together.
Figure 11:
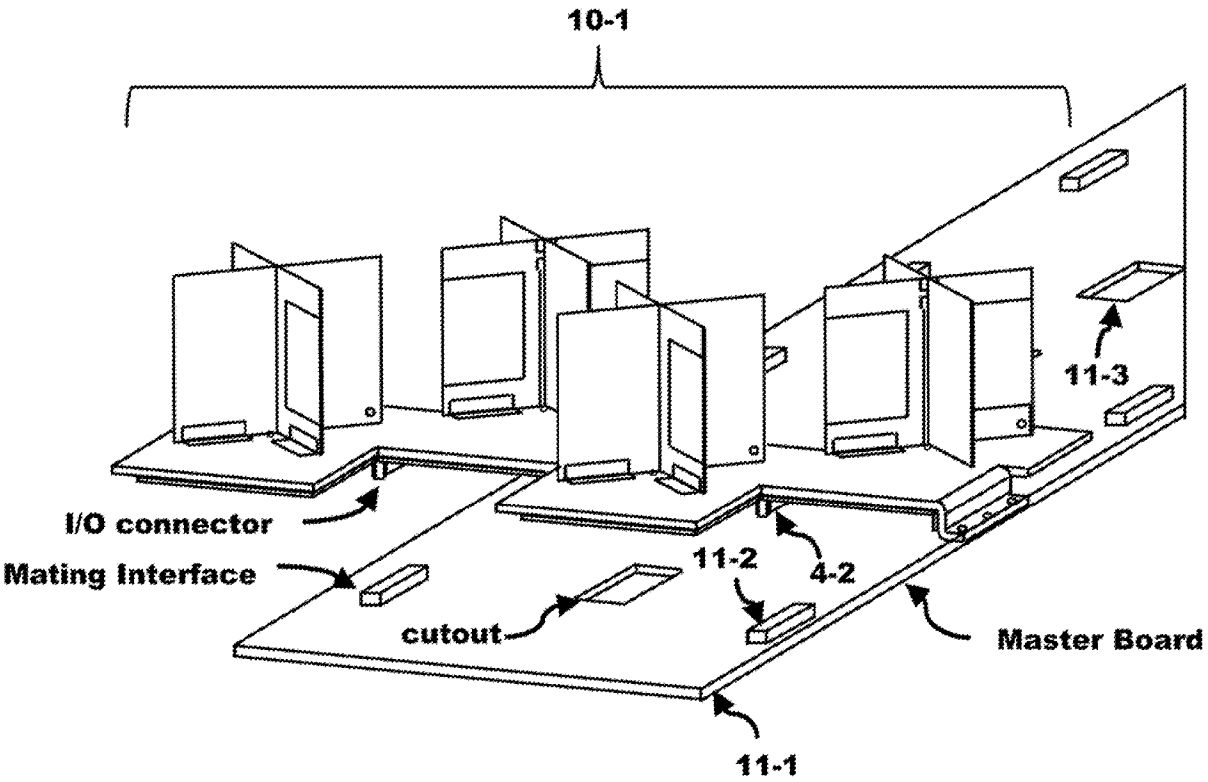
FIG. 11 presents a perspective view of the modules and a master board.

FIG. 9 presents a perspective view of two modules 7-1 side-by-side. FIG. 10 illustrates the placement of two modules 7-1 together to form the component module 10-1. FIG. 11 illustrates a perspective view of the component module 10-1 in relation to a master board 11-1. The master board routes the intermediate frequency (IF) and local oscillator (LO) signals to a plurality of component modules (and in this particular illustrative embodiment includes only passive electrical components and no active electrical components). More specifically, the master board distributes one or more LO signals and outgoing IF signals from at least one source location on the master board to every module via this connectors, distributes one or more incoming IF signals received from the modules via the connectors to at least one sink location on the master board, and uses either a corporate feed network or a bidirectional signaling (BDS) network for the distribution network. The BDS network reduces the overall transmission line length and signal loss between the source and destination when compared to the corporate feed network since the BDS is a serial link distribution. For a description of the BDS network, see U.S. Pat. Pub. No. 2014/0037034, entitled "Method and System for Multi-point Signal Generation with Phase Synchronized Local carriers," published Feb. 6, 2014, the contents of which are incorporated herein by reference in their entirety.

The master board is a PWB with exposed metal covering its backside. The I/O connectors 4-2 of the component module are aligned with the mating interfaces 11-2 located on the master board 11-1. The mating interface 11-2 is a male connector while the I/O connector 4-2 is a female connector, although the position of these male/female connectors can be exchanged. Once the I/O connector mates with the mating interface of the master board, the module circuit board can tap into the IF/LO network distributed on the master board. The master board 11-1 also has cutout openings 11-3 that are aligned with the module standoff and module foot of the modules forming the component module 10-1, several of which are currently hidden from view. These cutout openings allow the module standoff and module foot of both modules to pass through the master board without being obstructed. The cutout openings allow the master board to be fabricated as a single circuit board instead of being fabricated as two or more circuit boards. A master board fabricated as a single circuit board ensures the electrical characteristics experienced by all IF and LO signals propagating to or from all of the modules of the phased array remains uniform. Segmenting the master board into two or more circuit boards increases the possible mismatch of the electrical properties of the electrical traces presented to the propagating IF and LO signals. The mismatch of the electrical characteristics between circuit boards can affect an important parameter known as "Synchronization Flight Time" which is undesirable. For a discussion of Synchronization Flight Time, see U.S. Pat. Pub. No. 2012/0142280, entitled "Low Cost, Active Antenna Arrays," published Jun. 7, 2012, the contents of which are incorporated herein by reference in their entirety.

Figure 12:
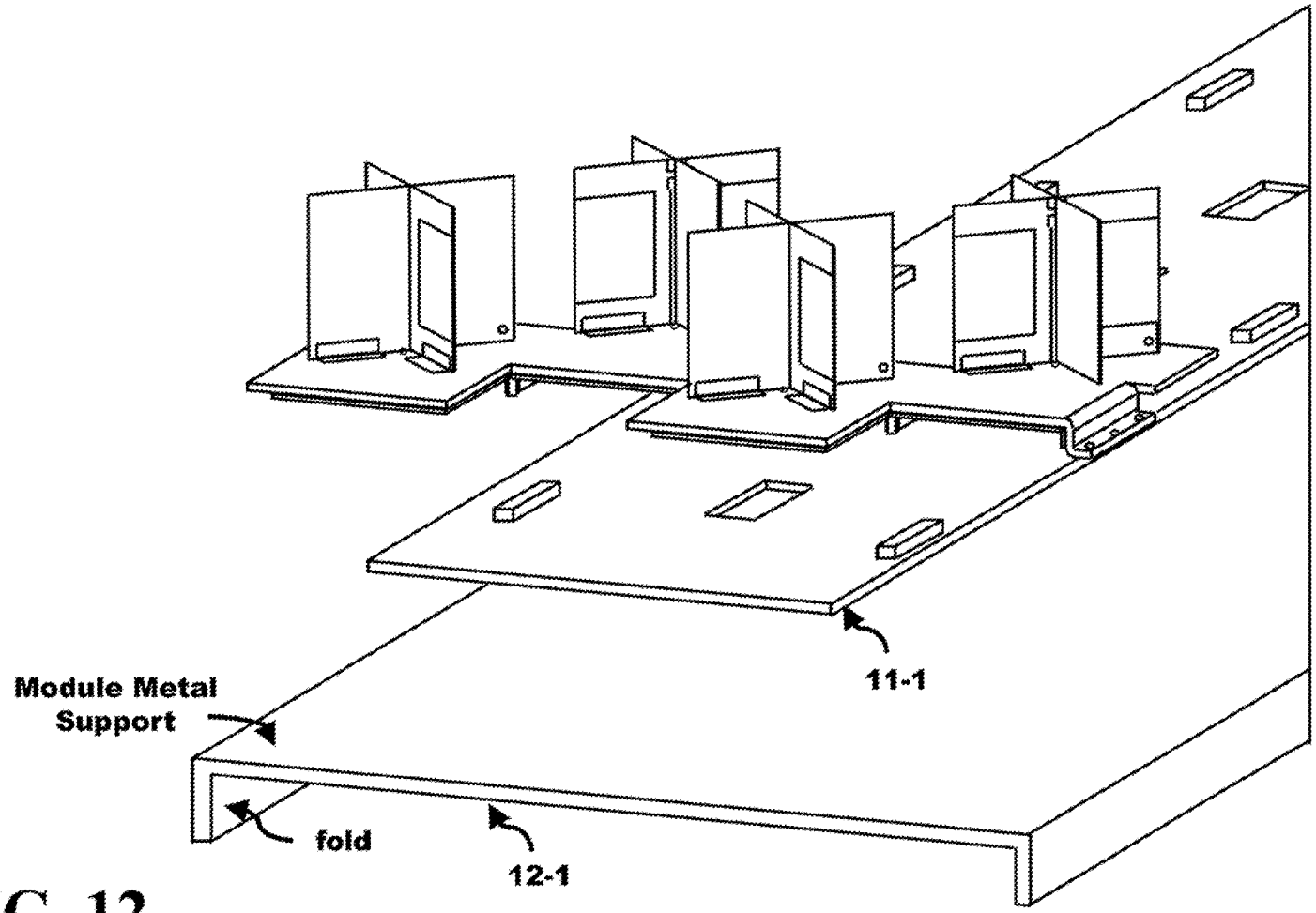
FIG. 12 shows a perspective view of the modules, master board and a module metal support.
Figure 13:
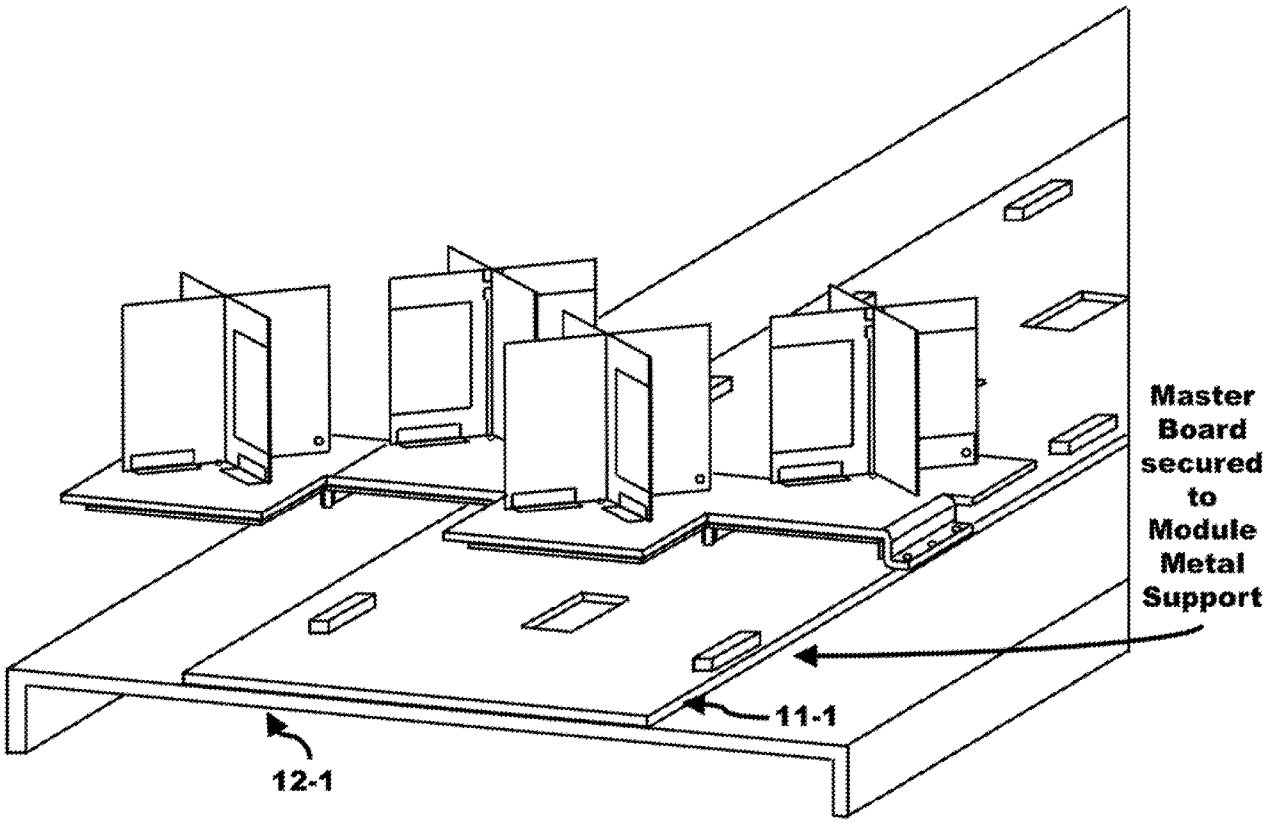
FIG. 13 illustrates the master board connected to the module metal support.
Figure 14:
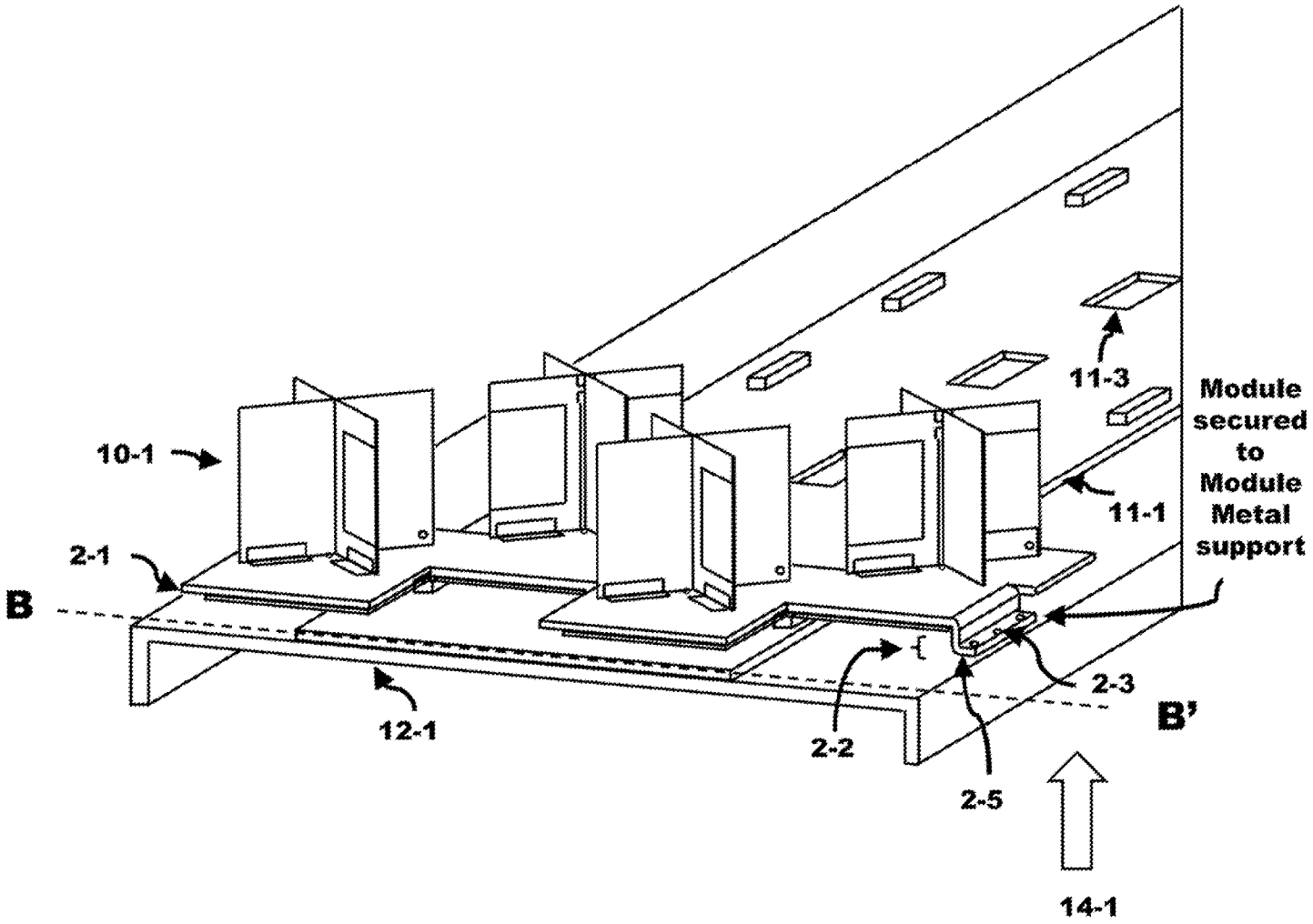
FIG. 14 depicts the modules connected to the module metal support

FIG. 12 presents a perspective view of a module metal support 12-1 in relationship to the master board 11-1 and the component module 10-1. The module metal support has a fold to provide additional strength to the structure of the module metal support, if required. FIG. 13 illustrates the master board 11-1 secured to the module metal support 12-1. In FIG. 14, the component module 10-1 is attached to the module metal support 12-1. The module standoff 2-2 is designed with a length perpendicular from the module metal plate to ensure that the cavity formed between the module metal plate 2-1 and the module metal support 12-1 is sufficiently sized to contain the master board 11-1 and allow for the insertion of the I/O connector 4-2 of each module into the mating interface 11-2 of the master board. The module foot 2-5 of the modules makes contact to the metallic surface of the module metal support. The cutout openings 11-3 allows the module foot (not visible) to pass through the master board 11-1 and make direct contact with the module metal support 12-1 for efficient heat transfer between the foot and support. Each module foot is attached to the module metal support by fasteners placed within the holes 2-3 of the module foot. These fasteners can be screws, nuts and bolts, quick release latches, etc. The fastener attaching the module foot to the module metal support insures that both a thermal connection and an electrical connection occur between these two components. The thermal connection transfers heat generated by the electrical components in the module to the module metal support 12-1. The electrical connect insures that the metallic structure of the module and the module metal support are at the same voltage potential. The module metal plate can be coupled to voltage supply, a ground potential for example, and serves as the ground plane for the antennas. A cross-sectional view along the perpendicular plane containing B-B' is presented next.

Figure 15:
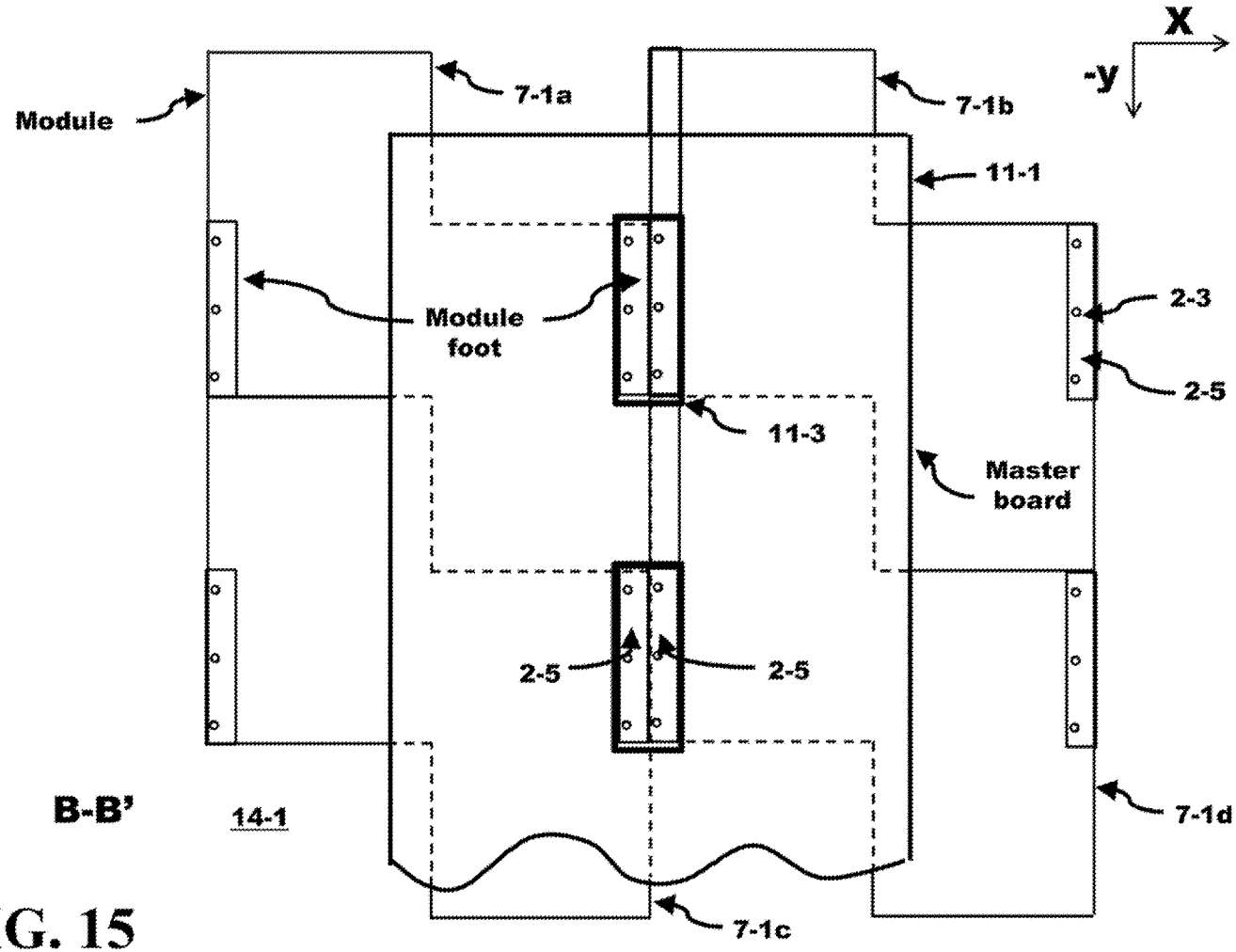
FIG. 15 illustrates depicts a cross-sectional view along the perpendicular plane containing B-B' of FIG. 14.

FIG. 15 depicts a bottom view 14-1 of the plane containing B-B'. Four module outlines 7-1*a*, 7-1*b*, 7-1*c*, and 7-1*d* are illustrated. Each module has two instances of the module foot 2-5. The master board 11-1 presents two cutouts 11-3.

The right foot of module 7-1*a* and the left foot of module 7-1*b* pass through the opening 11-3 of the master board 11-1. The two modules 7-1*a* and 7-1*b* forms one instant of the component module 10-1. A second instant of the component module 10-1 is formed by modules 7-1*c* and 7-1*d*. The module is shaped to fit together when placed side-by-side. Each foot 2-5 contains holes 2-3 to allow each of the modules to be attached to the module metal support 12-1 which has corresponding matching holes. Note that the phased array can be increased in size in the negative Y direction by adding more modules in each column and correspondingly extending the master board. Similarly, if desired, the phased array can be increased in the X direction by adding another column of modules and extending the master board to the right and including additional cutouts in the master board.

Figure 16:
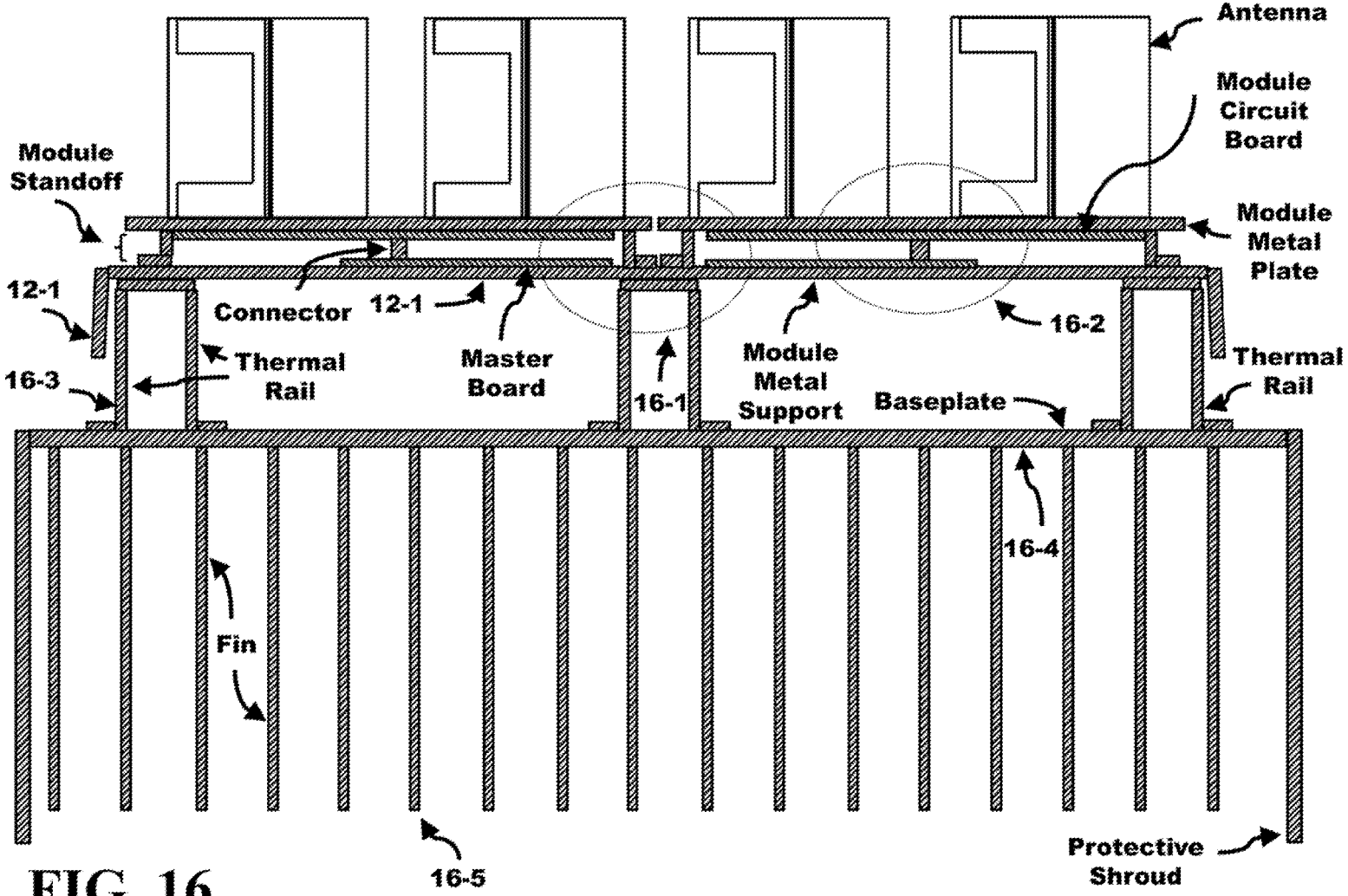
FIG. 16 shows a top view of the phased array.

FIG. 16 illustrates a cross-sectional view of an assembled phased array. The antennas are mounted to the module metal plate while the module standoff and module foot are connected to the module metal support. The module circuit board is connected to the bottom side of the module metal plate via the gasket. The master board is connected to the module metal support and illustrates the cutout within the region of the dotted ellipse 16-1. The cutout allows each module foot to pass through the plane of the master board and to make contact to the module metal support. The module circuit board is electrically connected to the master board by the connector formed by the I/O connector being mated with the mating interface. Thermal rails 16-3 connect the module metal support to a baseplate 16-4. The thermal rails are positioned beneath the module standoff and corresponding module foot to minimize the thermal impedance between these two components. This minimizes the thermal impedance for the heat flowing from the module circuit board to the thermal rails. The baseplate adds further structural support to the phased array and distributes the heat received from the thermal rails over the entire baseplate. The distributed heat moves laterally and vertically downwards in the baseplate. The heat flows to the multiple fins 16-5 that are connected to the bottom of the baseplate and the outer protective shroud that protects the outermost fins. One embodiment of the phased array uses aluminum as the metal forming the structural components: module metal plate; module metal support; thermal rail; baseplate; fins; and protective shroud to reduce costs and weight, although other metals are also suitable. Examples of metals with large thermal conductivity include but are not limited to copper, silver, zinc, nickel, iron, etc. For example, metal alloys can be used in the construction of the system. The thickness of the metal components is about 3000 μm to amply carry the heat, offer structural integrity, minimize cost, and minimize the weight of the phased array. Thicknesses more than 3000 μm can be used if the weight is not an issue, while thicknesses less than 3000 μm offer less weight at increased thermal resistance. Furthermore, the type of metal used and the thicknesses used for each metal component can be independently chosen and adjusted, respectively, as alternative embodiments to fabricate a phased array that achieves a desired cost, weight, heat extraction, and strength for the unit. The dotted ellipse 16-1 and the dotted ellipse 16-2 identify regions that will be magnified to present these regions in greater detail.

The disclosed structure of the PWB attached to the module metal plate significantly reduces the lateral thermal impedance along the metal sheets within the PWB. The thin copper layer on the backside of the PWB (typically only 25 microns thick) has limited ability conduct heat away from the heat generating electrical components. The module metal plate offers a lateral heat flow path in addition to what is available within the copper metal sheets of the PWB by themselves. Furthermore, the module metal plate can be designed with a thickness significantly greater than 25 microns thus providing a much more effective way of moving the heat away from the heat generating components on the PWB. One embodiment of the module metal plate uses aluminum with a thickness of 3000 microns, which is over two orders of magnitude thicker than the metal sheets typically used within the PWB. The lateral thermal impedance of this embodiment can reduce the thermal impedance by nearly two orders of magnitude.

Figure 17:
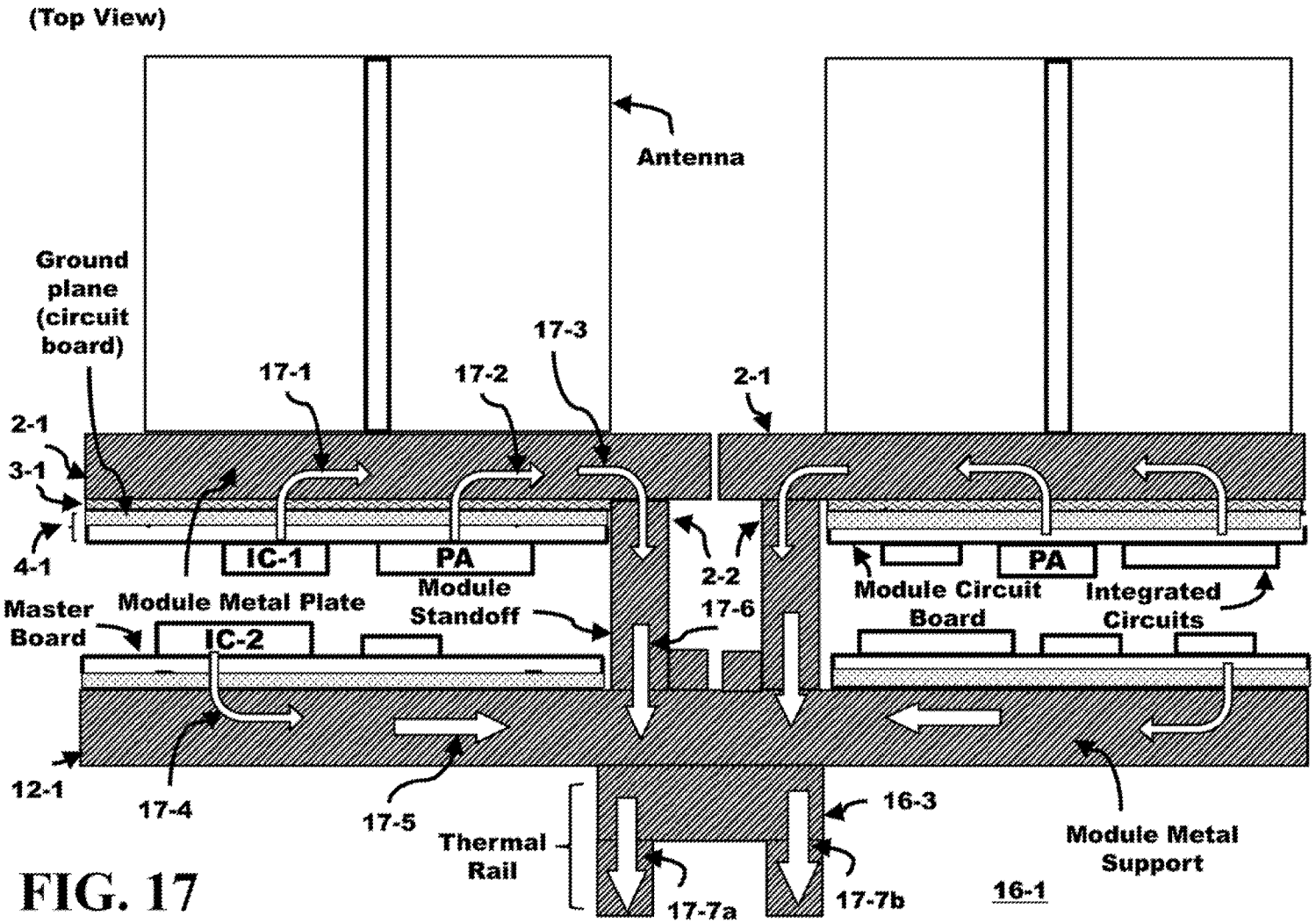
FIG. 17 shows a close-up view of the region 16-1 in FIG. 16.

FIG. 17 illustrates the region 16-1 of FIG. 16 in greater detail indicating the heat flow from the components (integrated circuits, active and passive elements, etc.) mounted on the circuit boards through the various structural components down to the thermal rail 16-3. The PA dissipates large quantities of heat during normal operation. A single PA can generate 25 W or more of heat. A phased array with 100 antennas each requiring a PA can generate as much as 2500 W. The heat generated by each PA needs to be removed from the phased array through a low thermal impedance path to the outside environment. One embodiment that achieves a low thermal impedance is described. The white arrows indicate the direction of heat flow through the structural components forming the phased array. The thickness of each arrow (if representing the magnitude of heat flow) may not be drawn to scale. Most of the structural components are made of metal except for the laminated layers of the PWB board. For example, the heat flow 17-1 and 17-2 from the surface mounted integrated circuit IC-1 and the PA flow perpendicular to the laminated layers within the circuit board 4-1 before reaching the ground plane of the circuit board. The gasket 3-1 insures that the circuit board 4-1 is in good thermal contact across the entire ground plane surface area of the circuit board. The gasket can alternately be replaced with paste, adhesive, or metallic glue, etc. or connected by fasteners (screws, bolts, etc.) to hold the circuit board to the module metal plate. The heat then flows through the low thermal impedance of the electrical insulating gasket 3-1 (if used) to the module metal plate 2-1.

The laminated layers of the PWB typically offer a high thermal impedance to the heat flow. This large thermal impedance can be reduced if the area of the PA package is increased to help spread out the heat over this larger area. In addition, the actual layout of the PA circuitry within the integrated circuit can also be redesigned and laid out over a larger surface area of the semiconductor. The heat generated by the power-consuming amplifier stage of the PA would then be spread out over a larger area within the semiconductor which would further help to reduce the thermal impedance of the laminated layers of the PWB between the packaged device and the module metal plate.

The module metal plate 2-1 channels the heat flow 17-3 to the module standoff 2-2 which transfers the heat to the module metal support 12-1. Most of the heat captured by the module metal plate is transferred to the module metal support as indicated by the heat flow 17-6 via the module standoff metallic components 2-2. The integrated circuit packages on the master board transfer their heat perpendicular through the PWB to the module metal support 12-1. For example, the heat flow 17-4 of integrated circuit IC-2 flows through the circuit board of the master board to the module metal support 12-1. The exposed metal layer on the backside of the master board is in direct thermal contact with the module metal support. A gasket may not be required since the heat generated by the master board is much less that of the module circuit board comprising the PAs. The heat flow 17-5 from all remaining components of the master board is carried by the module metal support 12-1 towards the thermal rail 16-3. The heat flow 17-6 from the module standoff 2-2 and the heat flow 17-5 from the module metal support combine as the heat flow 17-7*a* and 17-7*b* in the thermal rail 16-3. Note that the thermal rail 16-3 is positioned below the module standoff 2-2 to minimize the thermal impedance between the module metal plate 2-1 and the thermal rail 16-3. This minimizes the thermal impedance for the heat flowing from the PA.

Figure 18:
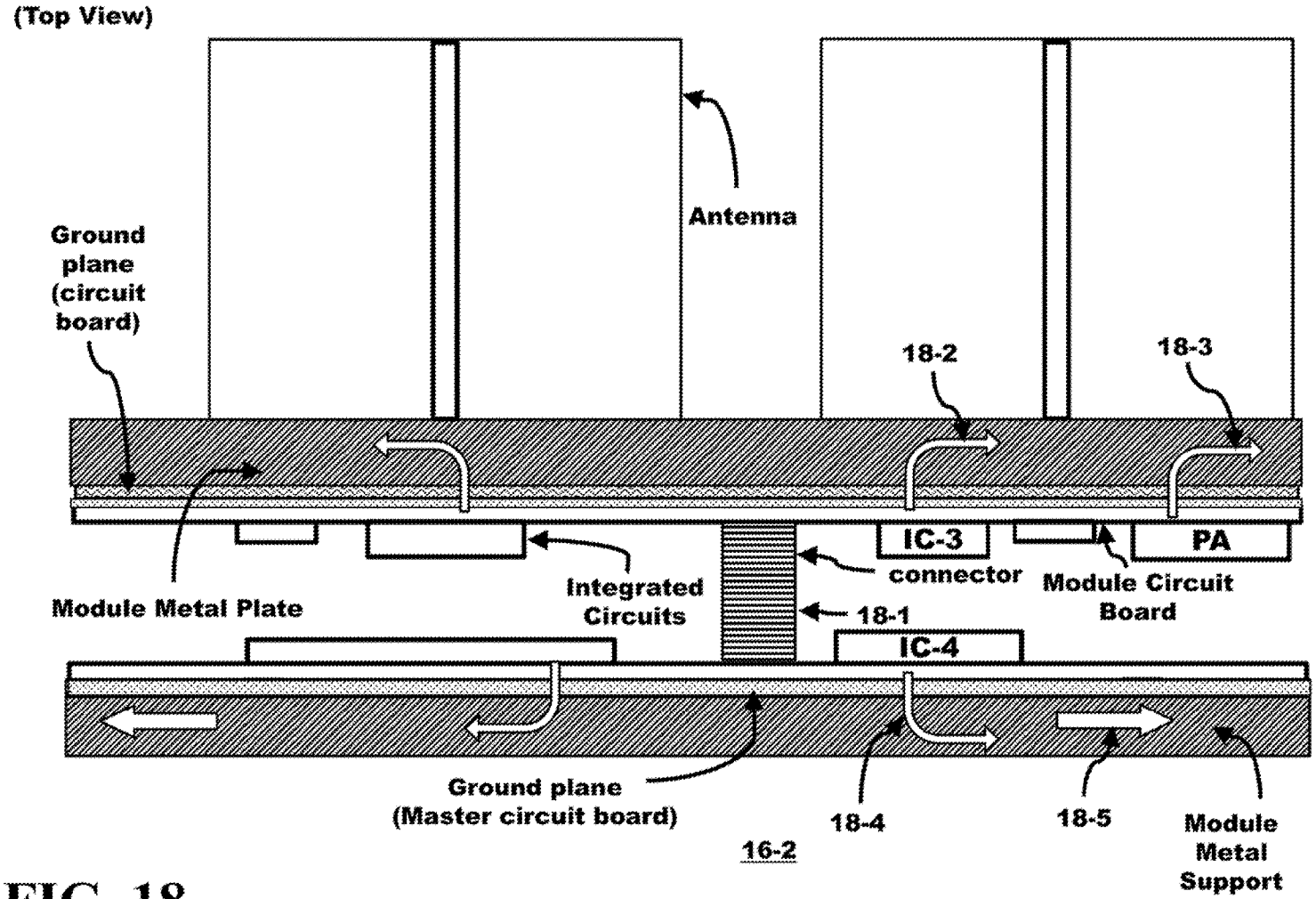
FIG. 18 depicts a close-up view of the region 16-2 in FIG. 16.

FIG. 18 illustrates the region 16-2 of FIG. 16 in greater detail indicating the heat flow from the components mounted on the circuit boards near the connector. The heat flow is indicated by the arrows through the structural components of the module metal plate and the module metal support. The connector 18-1 is used to transfer signals between the module circuit board and the master board. The connector typically has a high thermal impedance and is not an efficient heat conductor. The white arrows indicate the direction of heat flow through the structural components from the module circuit board and the master board PWBs. Most of the structural components are made of metal except for the laminated layers of the PWB board. For example, the heat flow 18-2 from the integrated circuit IC-3 flows perpendicular to the laminated layers within the module circuit board before reaching the ground plane of the circuit board. The heat then flows through the electrical insulating/heat conducting gasket to the module metal plate. The module metal plate channels most of the heat flow 18-2 towards the nearest module standoff (not shown) which transfers the heat to the module metal support. The heat flow 18-3 of the PA flows along a similar path. The heat captured by the module metal plate is transferred to the module metal support (not shown). The integrated circuit packages on the master board transfer their heat through the PWB to the module metal support. For example, the heat flow 18-4 from integrated circuit IC-4 flows through the master board to the module metal support. The heat flow 18-5 from the components of the master board is carried by the module metal support towards the thermal rail (not shown).

Figure 19:
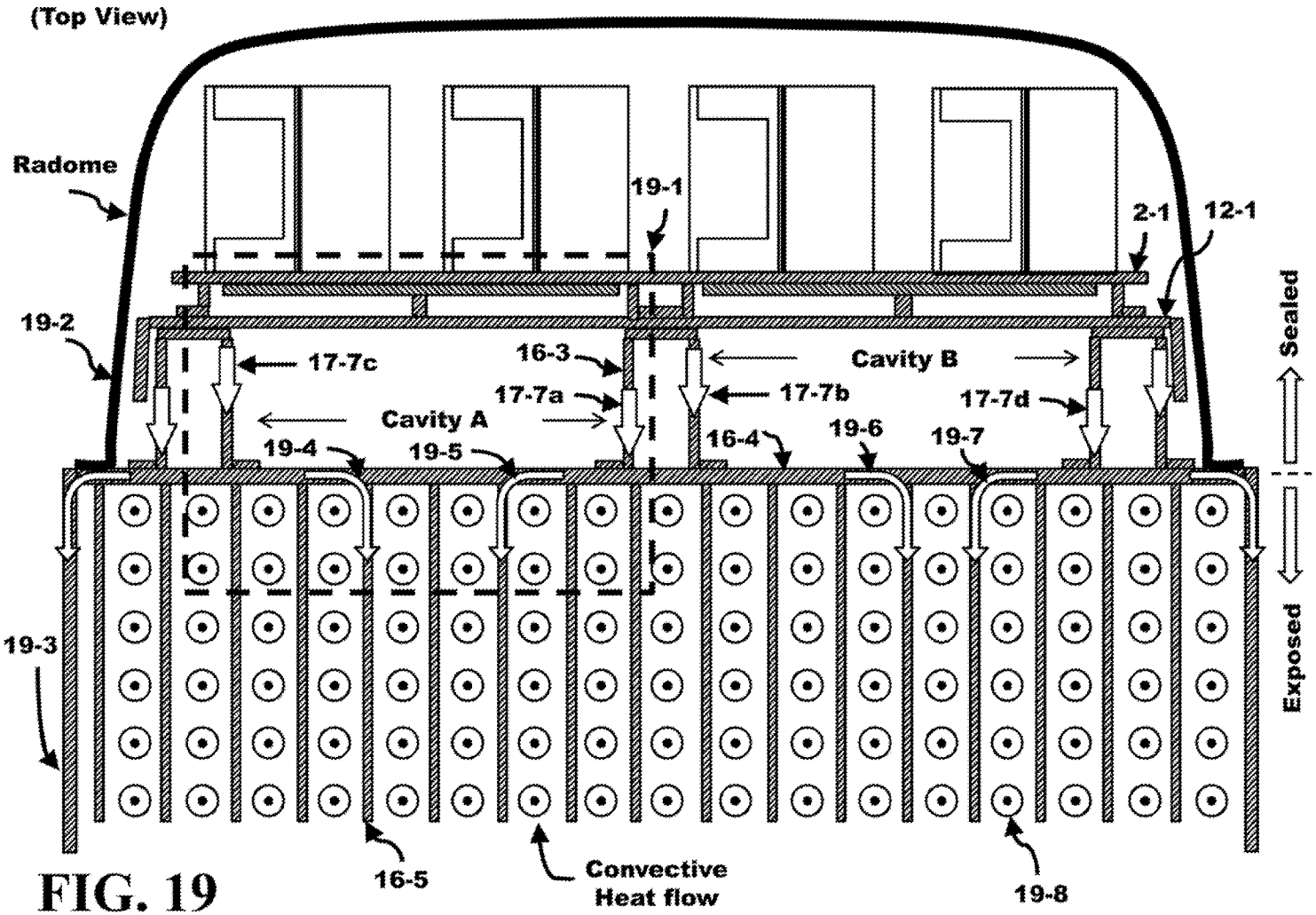
FIG. 19 illustrates a top view of the phased array with the radome sealing a portion of the phased array and the convective heat flow from the exposed fins.

FIG. 19 illustrates a cross-sectional top view of the phased array covered with an RF transparent radome. In other words, the radome is a shield that allows the passage of RF energy while also acting as a barrier to weather conditions in the exterior environment. The radome 19-2 is attached to the baseplate 16-4 forming a sealed volume containing the antennas, the module metal plate 2-1, the module standoffs, the module metal support, and the thermal rails. The thermal rail 16-3 is sized in length to create internal cavities A and B between the baseplate 19-5 and the module metal support 12-1 within the sealed environment. These cavities can be filled with most of the remaining electronics necessary to operate the phased array. Thus, the electronics within the phased array is in the sealed volume of the phased array. The sealed volume within the radome protects all of the electronics from the harsh weather conditions but also constitutes a sealed volume that prevents effectively using convection heat to exchange the heat generated by the enclosed electronics with the external environment. The heat generated by the electronics within this sealed section is instead removed by the use of the conductive heat flow formed by the metallic structural components of the phased array. The metallic structural components can be constructed as individual pieces, these individual pieces can be held together by gluing, welding, riveting, swaging, or by the use of nut and bolts. Swaging is a slot-peg system that press fits two pieces together where the peg and slot are mated together and press fitted together. Some individual pieces can be formed by bending sheets of flat metal into doglegs or more complex contours. The completed construction of the metallic structural components forms a metallic skeleton that transfers heat from the electrical components to the exterior fins of the phased array.

Heat pipes could also be mounted to the metallic supports to carry the heat generated by the PAs and electronic components of the phased array. The heat pipes absorb heat from the metallic supports which vaporizes a liquid in a sealed container and condenses back into a liquid at the other end of the sealed container releasing heat in the process. The heat pipe could, for example, contact the module metal plate 2-1 within the sealed portion of the system. The other end of the sealed container of the heat pipe can be extended outside of the sealed system to release the heat into the ambient environment. The heat pipe would offer a high thermal conductivity path between any internal points of the sealed system to any external point within the ambient environment.

Heat pipes could also be mounted to the side of the baseplate 16-4 that is attached to the fins 16-5. The heat pipe would help the lateral conduction of heat along the baseplate. The heat pipe can also be in direct contact with the fins (a slot in the fins to fit the heat pipe) and the baseplate simultaneously. The heat from the baseplate can more readily spread laterally and to the fins at the same time. Such a heat pipe configuration can be used to extend the width of the baseplate to emit heat over a larger area. The heat pipe would offer a high thermal conductivity path between any two external points of the system within the ambient environment.

FIG. 19 illustrates how these metallic structural components provide a conductive heat flow path from the electronics within the sealed volume to the external environment. The heat generated by these electronic components within the sealed phased array flow through each of the thermal rails (for example, 17-7*a*, 17-7*b*, 17-7*c*, 17-7*d*, etc.) to the baseplate 16-4. The baseplate 16-4 collects and conductively transfers the heat through the baseplate to the opposite side of the baseplate. The opposite side of the baseplate 16-4 has a plurality of metal fins 16-5 attached to the baseplate. The heat from the baseplate conductively flows into the plurality of fins as indicated by the heat flows 19-4 through 19-7. The fins are partially enclosed by a protective shroud 19-3 on the sides. However, the bottom and top of the phased array corresponding to the location of the fins 16-5 are open to the external environment. Therefore, these fins are exposed to the external environment allowing convective heat flow 19-8 to occur between the fins and the air of the external environment. Optimally, the fins can be orientated perpendicular to the surface of the earth. As the fins become heated by the conductive transfer of heat from the baseplate 16-4, the heat from the fins is transferred via convective heat flow to the air in between the fins. The heated air rises and flows out the top of the phased array. This causes a vacuum, which introduces cooler air from the external environment to enter into the bottom of a vertically aligned phased array. The newly entered air experiences a convective heat flow from the fins extracting heat from the phased array and is emitted from the top of the phased array. This process of heat exchange from the fin to the moving air between the fins extracts the heat from the phased array. An electrical fan can be placed within the air flow path to force the flow of air between the fins. This air flow increases the velocity of the air flow and helps extract a greater amount of heat from the fins in a given time period. The dashed square 19-1 containing cavity A is further illustrated in FIG. 20.

Figure 20:
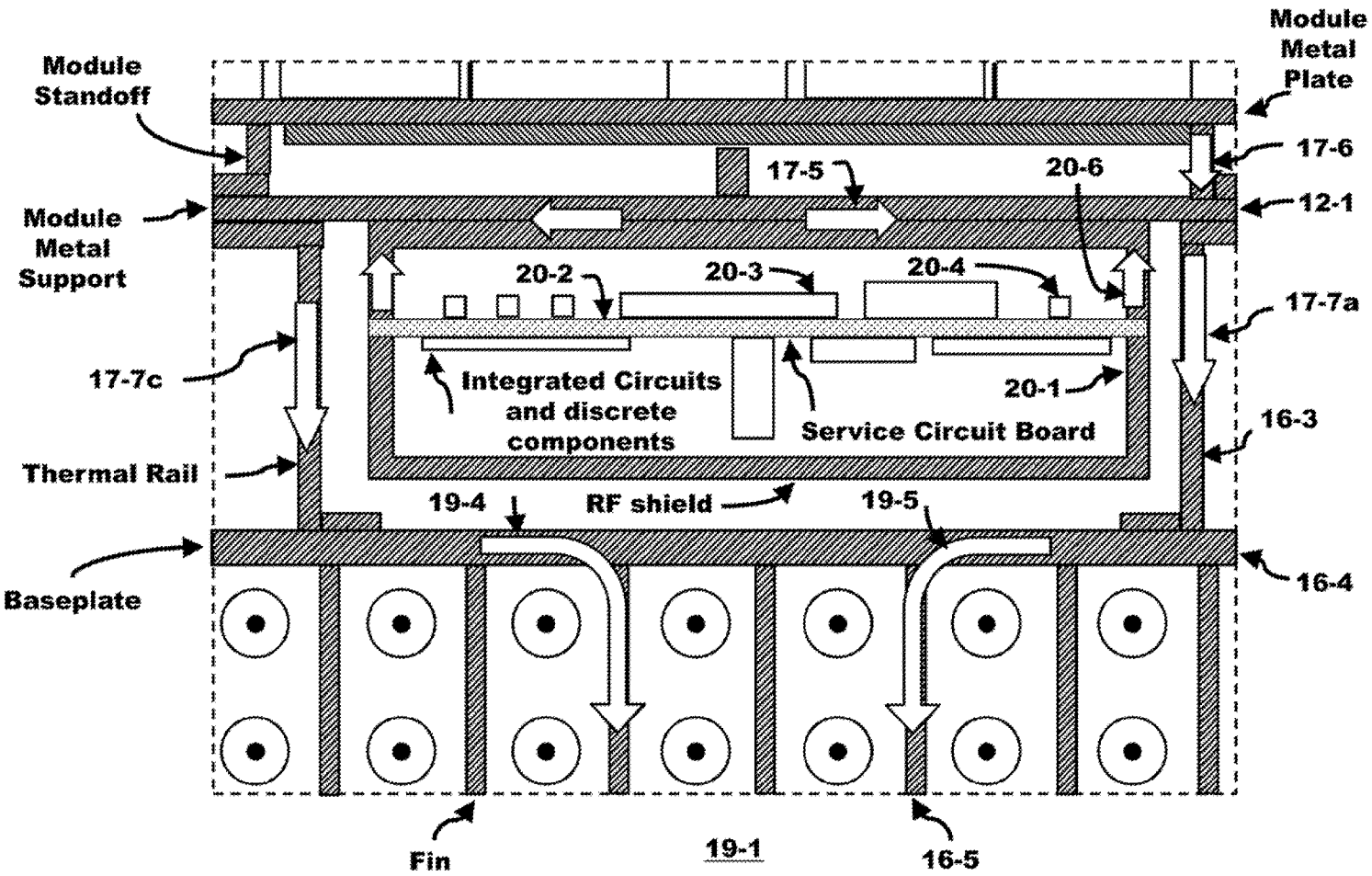
FIG. 20 illustrates a close-up view of the region 19-1 in FIG. 19 with the volume A comprising an RF-shielded component.

In FIG. 20, in one embodiment, cavity A is filled with a double-sided service circuit board 20-2 with integrated circuits and discrete components 20-3 and 20-4 and similar components mounted to the board. The service circuit board 20-2 is enclosed by a metallic RF shield 20-1 to shield the sensitive electronics from the RF energy emitted by the antennas of the phased array. The shield is attached to the module metal support. The heat generated by the service circuit board flows along the paths 20-6 and joins with the heat flow 17-5 generated by the master board. The heat flow 17-6 from the module circuit board flows within the module standoff. The heat flows 20-6, 17-5, and 17-6 are collected by the thermal rail as the heat flow 17-7*a*. The heat flow 17-7*a* along the thermal rail 16-3 transfers to the baseplate 16-4. The heat flow from the thermal rail is transferred along and through the baseplate to the plurality of fins. For example, the heat flow 19-5 from the baseplate flows to the fin 16-5. Similarly, the heat flow 17-7*c* in another thermal rail is due to the combination of the heat flows from the service board, master board, and the module circuit board. The heat is transferred to the baseplate and the plurality of fins (for example, 19-4). The plurality of fins then transfers the heat from the baseplate and exchange the heat to the air convectively.

Figure 21:
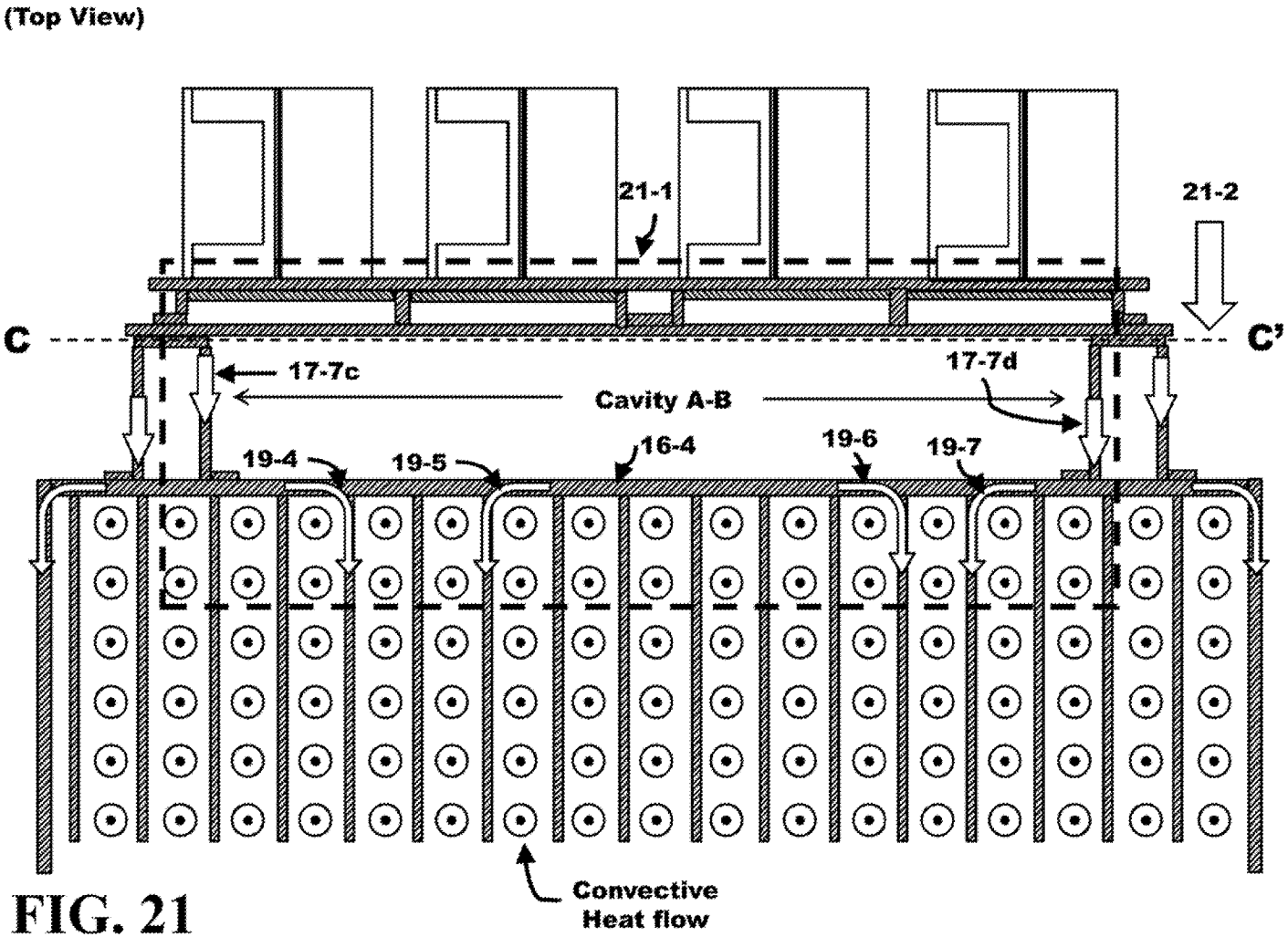
FIG. 21 illustrates a top view of the phased array with larger volume A-B and the convective heat flow from the exposed fins.
Figure 22:
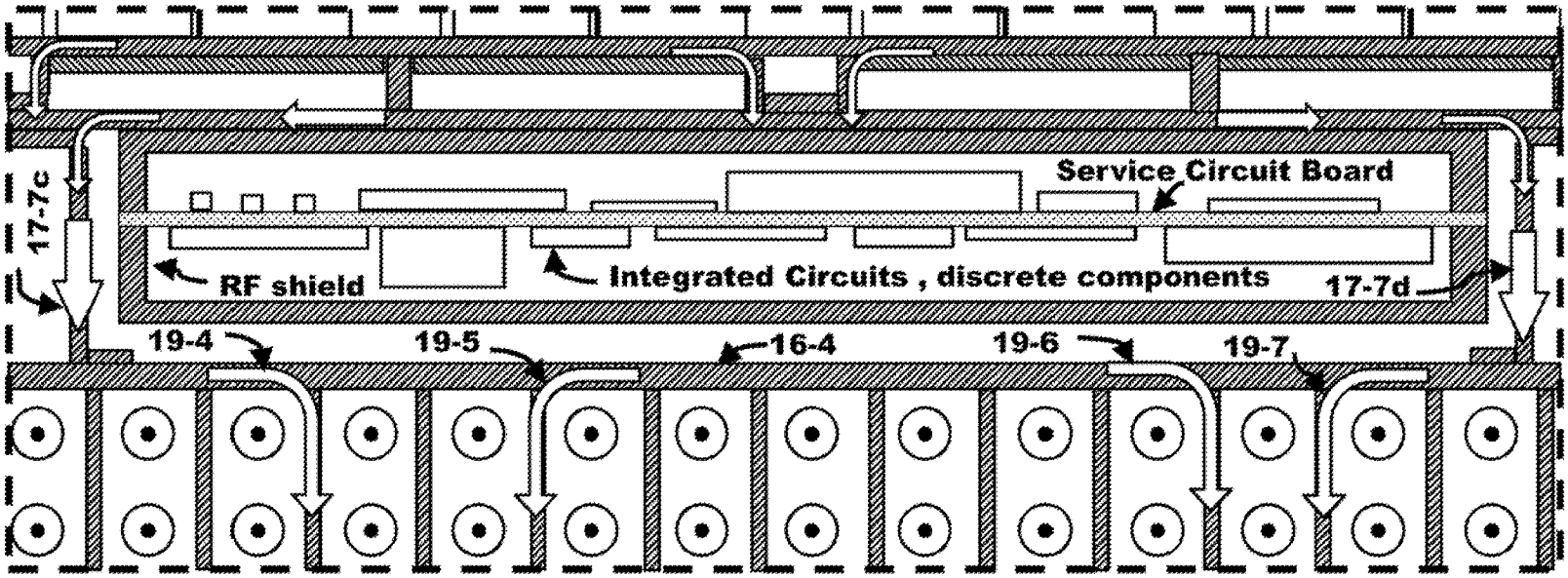
FIG. 22 illustrates a close-up view of the region 21-1 in FIG. 21 with the volume A-B comprising an RF-shielded component.

FIG. 21 depicts the removal of the middle thermal rails thereby enlarging the cavity. The larger cavity A-B allows a larger circuit board to be inserted within the cavity. An example of this cavity being filled with a circuit board is illustrated within the dashed rectangle 21-1 as depicted in FIG. 22. The service board now stretches across width of the phased array and, in one embodiment, has a number of integrated circuit in discrete components mounted on both sides of the circuit board. The entire circuit board is surrounded by in RF shield to prevent the RF radiation from the antennas interfering with the operation of the integrated and discrete components circuits on the service circuit board. The heat generated by the service circuit board, the master board, and the module circuit board combine in the thermal rails as heat flows 17-7*c* and 17-7*d*. The heat from the thermal rails flow to the baseplate 16-4 and passes along the baseplate to the plurality of fins (for example, 19-4 through 19-7) that are attached to the baseplate. The plurality of fins transfers the heat to the air between the fins.

Figure 23:
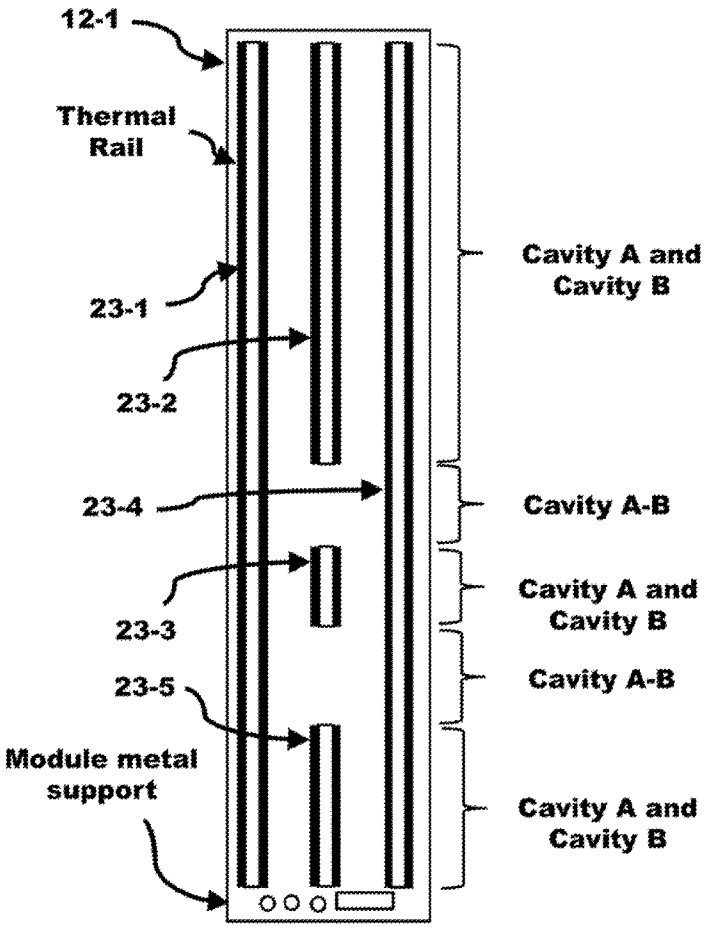
FIG. 23 illustrates a cross-sectional view along the perpendicular plane containing C-C' of FIG. 21 presenting the thermal rails.

Returning back to FIG. 21, a perpendicular view 21-2 of the plane containing the line C-C is presented in FIG. 23. The baseplate 16-4 is presented along with thermal rails 23-1 through 23-5. The middle thermal rail is segmented into three parts: 23-2, 23-3, and 23-5. Wherever the middle thermal rail is missing defines the creation of cavity A-B, while the locations where the third middle rail is existing defines the formation of cavity A and cavity B. The circuit boards formed within the larger cavity A-B is used to transfer signals between the circuit boards formed in the individual cavities of cavity A and cavity B. The lower rectangle and three openings at the bottom of the baseplate are used for conduit that transfer signals to and from the electronics within the phased array.

Heat pipes can be connected between one thermal rail to another thermal rail or between the module metal support 12-1 and one of the thermal rails. For example, a heat pipe could be used to connect thermal rail 23-3 to thermal rail 23-2, thermal rail 23-3 to thermal rail 23-2 including making contact with the module metal support 12-1, or the thermal rail 23-1 to thermal rail 23-2. The heat pipe would offer a high thermal conductivity path between any two internal points of the sealed system.

Figure 24:
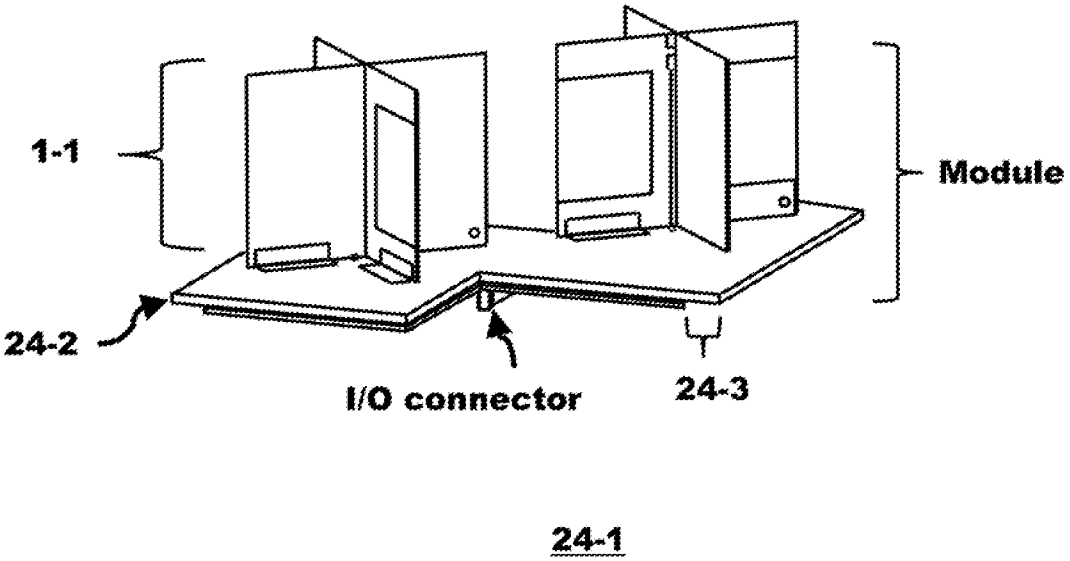
FIG. 24 illustrates a module without the module standoff comprising four components: cross pole antennas; Module Ground Plane; heat conducting gasket; and module circuit board connected together forming a module.

FIG. 24 depicts the complete module 24-1 after attaching the module circuit board the gasket and the gasket to the bottom surface of the module metal plate. The gasket can electrically isolate the module circuit board from the module metal plate. However, the gasket has a high thermal coefficient and transfers heat generated by the circuit components on the circuit (particularly the PA) to the module metal plate. The module after assembly comprises the two cross pole antennas and at least one I/O connector. The module 24-1 is used as a building block to construct the phased array. FIG. 24 illustrates another embodiment of a module for a phased array. The module metal plate 24-2 has metal extensions 24-3. The metal extensions offer a large contact area to minimize the thermal impedance and improve heat removal from the module metal plate. For a description of other forms of module designs and information on the assembly, electrical and structural characteristics of the module and other components of the module phased array, please refer to "Modular Phased Array", U.S. Prov. App. No. 62/195,456, by Robert Frye, Peter Kiss, and Josef Ocenasek, submitted Jul. 22, 2015, the disclosure of which is incorporated herein by reference in its entirety. A cross sectional view of 24-1 is presented in the next figure.

Figure 25:
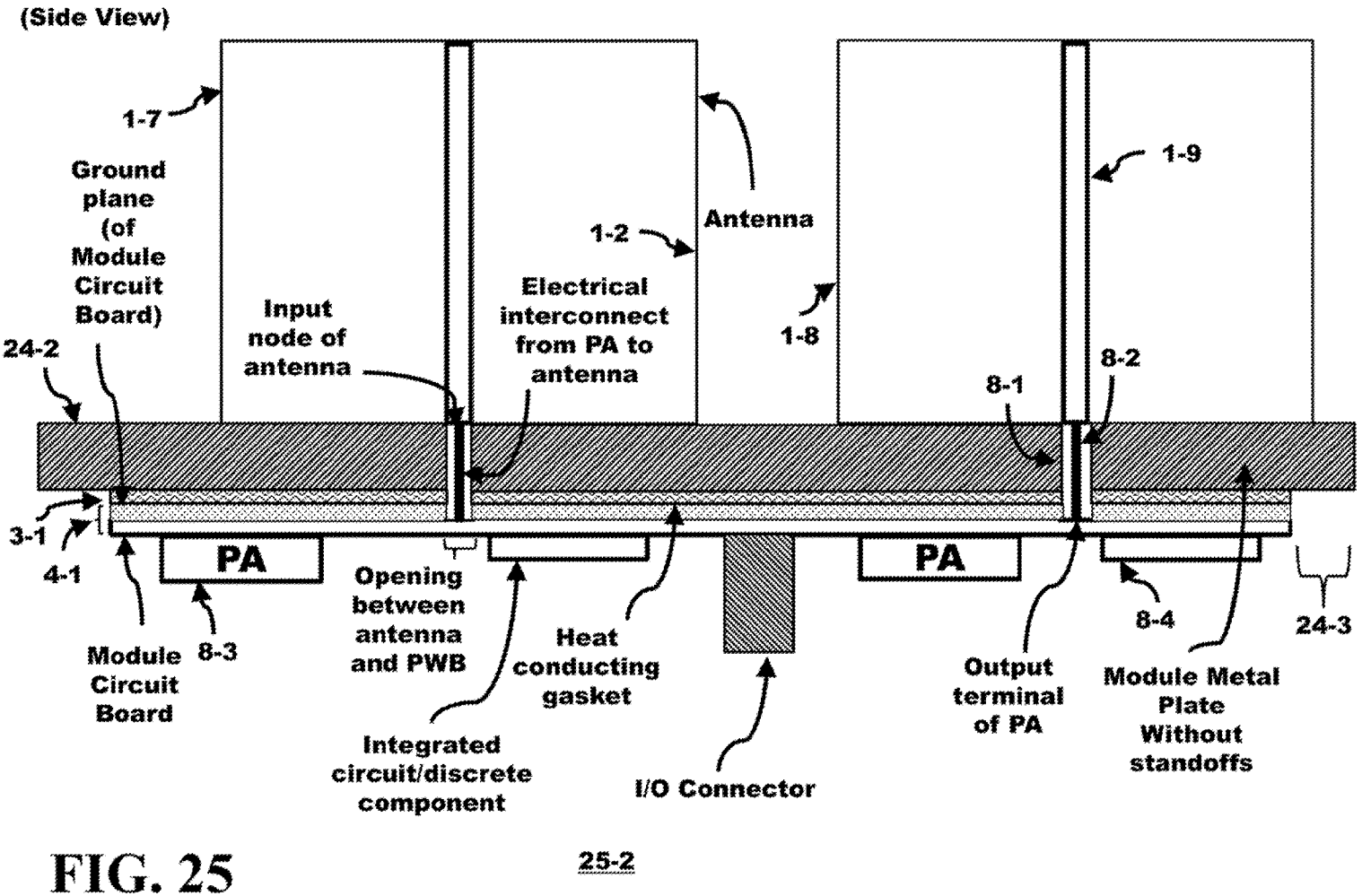
FIG. 25 depicts a cross-sectional view of FIG. 24.

FIG. 25 illustrates another embodiment of the cross-sectional side view 25-2 of the module in a plane perpendicular to the module metal plate. The right cross pole antenna comprising the segments 1-8 and 1-9 is aligned at the intersection of the segments over the hole 8-1. The hole 8-1 consists of the alignment of the hole formed in the module metal plate 24-2, with the hole formed in gasket 3-1, and the hole in the module circuit board. The hole 8-1 creates an opening between the lead of the antenna located on one side of the module metal plate and the output lead of the PA that is mounted on the module circuit board (PWB) located on the other side of the module metal plate. A metallic interconnect 8-2, insulated or bare wire, can be used to connect the output lead of the PA to the input lead of the antenna. The wire and hole have appropriate dimensions to create a coaxial electric interconnect characterized with an impedance of approximately 50 ohms, although other impedance values can be designed with alternative values. In one embodiment, the metallic interconnect is soldered to the lead on the top surface of the PWB, the other end of the metallic interconnect is soldered to the lead of the antenna. Other methods of connecting the metallic interconnect at one or both ends are available that would be suitable as alternative embodiments of the subject matter of the disclosure. Examples are crimp-on connectors, plug and socket connectors, blade connectors, etc.

Some or all of the electrical components associated with the PWB's within the phased array can be shielded using an RF shield. The electrical system of the phased array (antennas, PA output leads) produces a large amount of electromagnetic radiation that may be picked up by nearby electrical components. An RF shield is a metallic cover positioned near these electrical components to isolate these components from the stray electromagnetic radiation. The RF shield attempts to form an enclosed environment for the electrical components (not illustrated). The RF shield blocks the electromagnetic radiation from interfering with the normal operation of other electrical components.

The left cross pole antenna comprising of the segments 1-7 and 1-2 is electrically coupled to the module circuit board 4-1 in a similar manner. The module circuit board 4-1 has an exposed copper layer in contact with the gasket 3-1. On the opposite side of the circuit board, the surface is populated with at least one PA 8-3, integrated circuits 8-4, discrete components, and at least one I/O connector. The gasket is a flexible material and helps to compensate for any non-uniform height variations on the ground plane side of the fabricated PWB caused by manufacturing steps due to through holes and such. Other embodiments of the disclosure can eliminate the gasket altogether. For example, the ground plane metal of the PWB can be connected to the module metal plate directly using fasteners (screws, bolts, etc.) to hold the two pieces together, or by the use of a paste, adhesive, or metallic glue, etc.

In another embodiment of the disclosure, the PA can be attached directly (not illustrated) to the module metal plate 24-2. In one embodiment, the PWB can have an opening where the integrated circuit of the PA can be inserted and attached directly to the module metal plate. The heat generated by the PA would conduct the heat through the integrated circuit directly to the module metal plate. The integrated circuit of the PA can be glued to the module metal plate using a heat conducting glue or paste. Wire bonds or a tab attachment can couple electrical signals between the PWB and the input/output pads of the PA. An output terminal of the PA can be connected to the antenna via the hole 8-1. The module metal plate 24-2 has a metal extension 24-3 that exposes a large metallic contact area. This metallic contact area can be used to transfer heat from the module metal plate.

In another embodiment of the disclosure, components can also be mounted onto the upper side of the PWB 4-1 (see FIG. 25) that is typically in contact with the heat conducting gasket which in turn is in contact with the bottom of the module metal plate. The ground plane 3-1 is typically formed on this side of the PWB, but a plurality of openings in the ground plane can be designed to allowing the mounting of these components onto the upper side of the PWB. In addition, the module metal plate can have a corresponding plurality of cut out regions in the module metal plate aligned with these components. Once the PWB is attached to the module metal plate, the cut out regions provide the space for these components so that the upper side of the ground plane of the PWB is in contact with the bottom of the module metal plate via the heat conducting gasket or any of the other means of a heat transfer conduction layer as mentioned earlier.

Figure 26:
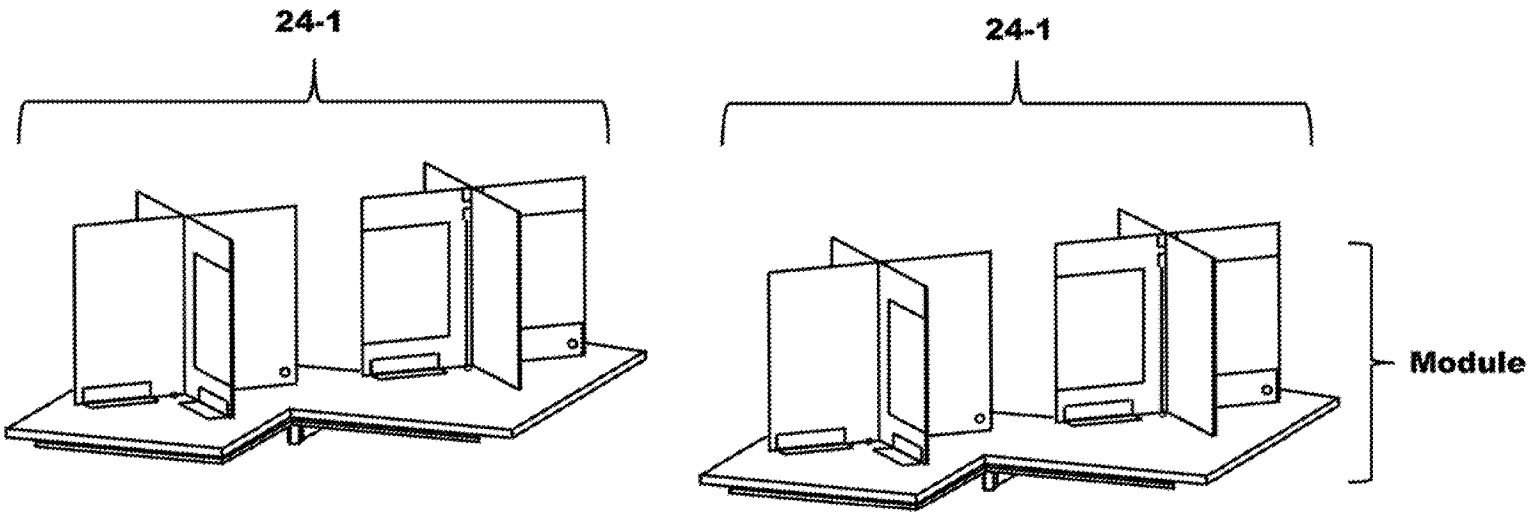
FIG. 26 depicts two instances of a module without the module standoff.
Figure 27:
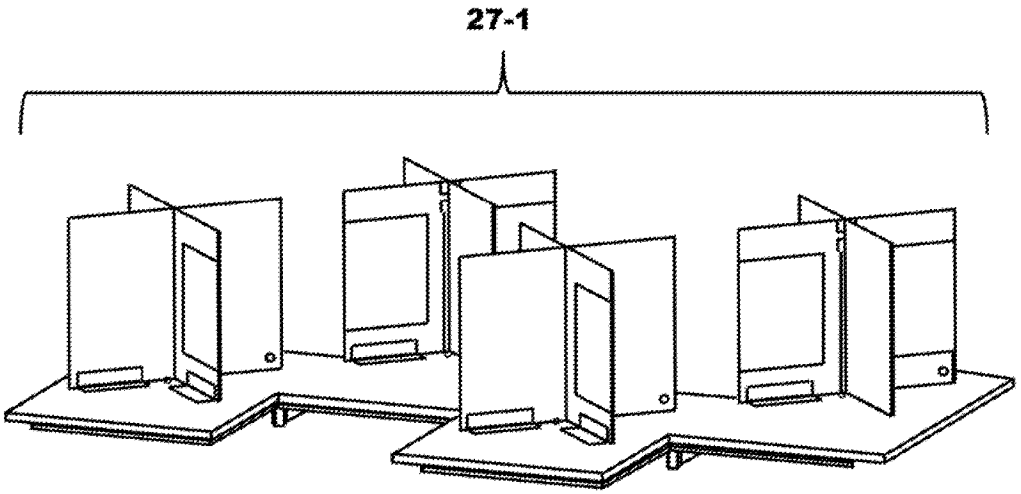
FIG. 27 shows the two instances of the modules without the module standoffs coupled together.
Figure 28:
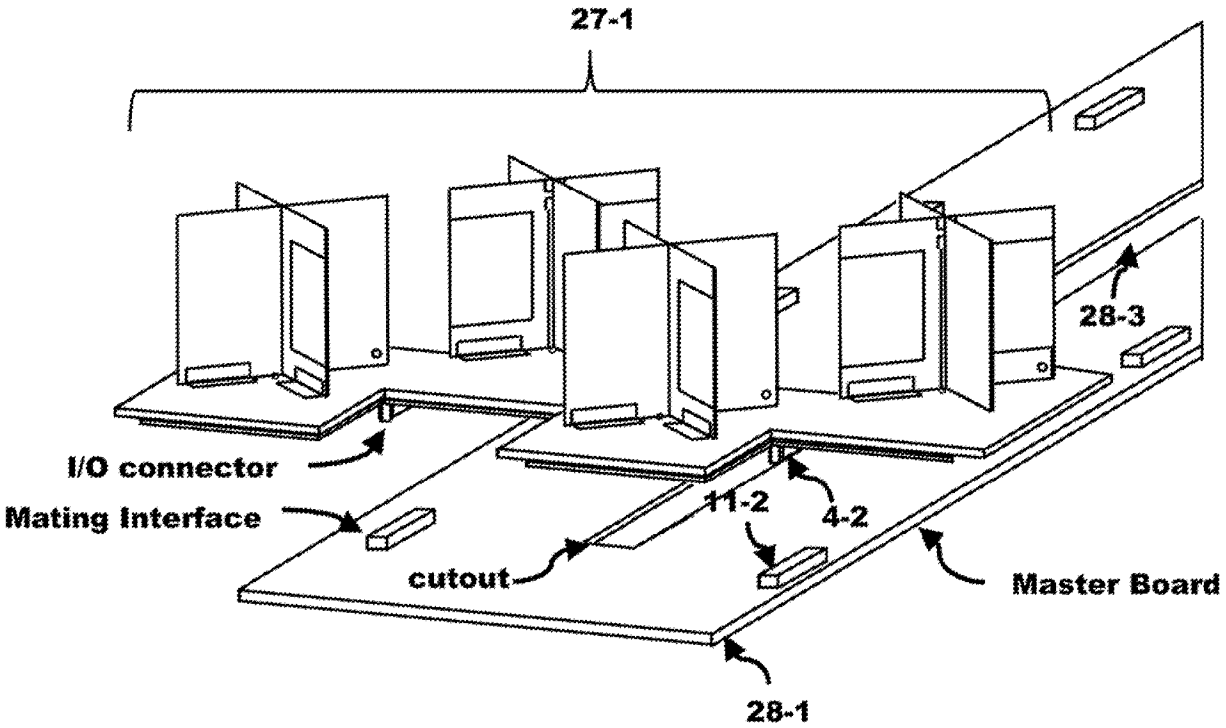
FIG. 28 presents a perspective view of the modules without the module standoffs and a master board.

FIG. 26 presents a perspective view of two separated modules 24-1 side-by-side. FIG. 27 illustrates the placement of two modules 24-1 together to form the component module 27-1. FIG. 28 illustrates a perspective view of the component module 27-1 in relation to another embodiment of the master board 28-1. The master board routes the intermediate frequency (IF) and local oscillator (LO) signals to a plurality of component modules. The I/O connectors 4-2 of the component module are aligned with the mating interfaces 11-2 located on the master board 28-1. The mating interface 11-2 is a male connector while the I/O connector 4-2 is a female connector, the male/female connectors can be inter-changed. Once the I/O connector mates with the mating interface on the master board, the module circuit board can tap into the IF/LO network distributed on the master board. The master board 28-1 also has a large cutout opening 28-3 that extends along most of the length of the board. The cutout opening provides for the possibility of forming a low thermal resistive path between the component modules and baseplate of the phase array as will be described shortly. The cutout opening extends along most of the master board in one embodiment, allowing the master board to be fabricated as a single circuit board instead of being fabricated as two or more circuit boards. A master board fabricated as a single circuit board ensures the electrical characteristics experienced by all IF and LO signals propagating to or from all of the modules along the master board experiences a similar electrical environment. Segmenting the master board into two or more circuit boards increases the mismatch of the electrical properties of the electrical traces presented to the propagating IF and LO signals. The mismatch of the electrical characteristics between circuit boards can affect an important parameter known as "Synchronization Flight Time" which is undesirable. For a discussion of Synchronization Flight Time, see Mihai Banu, Yiping Feng, and Vladimir Prodanov for a detailed description in "Low Cost, Active Antenna Arrays" U.S. Pat. Pub. No. 2012/0142280, published Jun. 7, 2012, the disclosure of which is incorporated herein by reference in its entirety.

Figure 29:
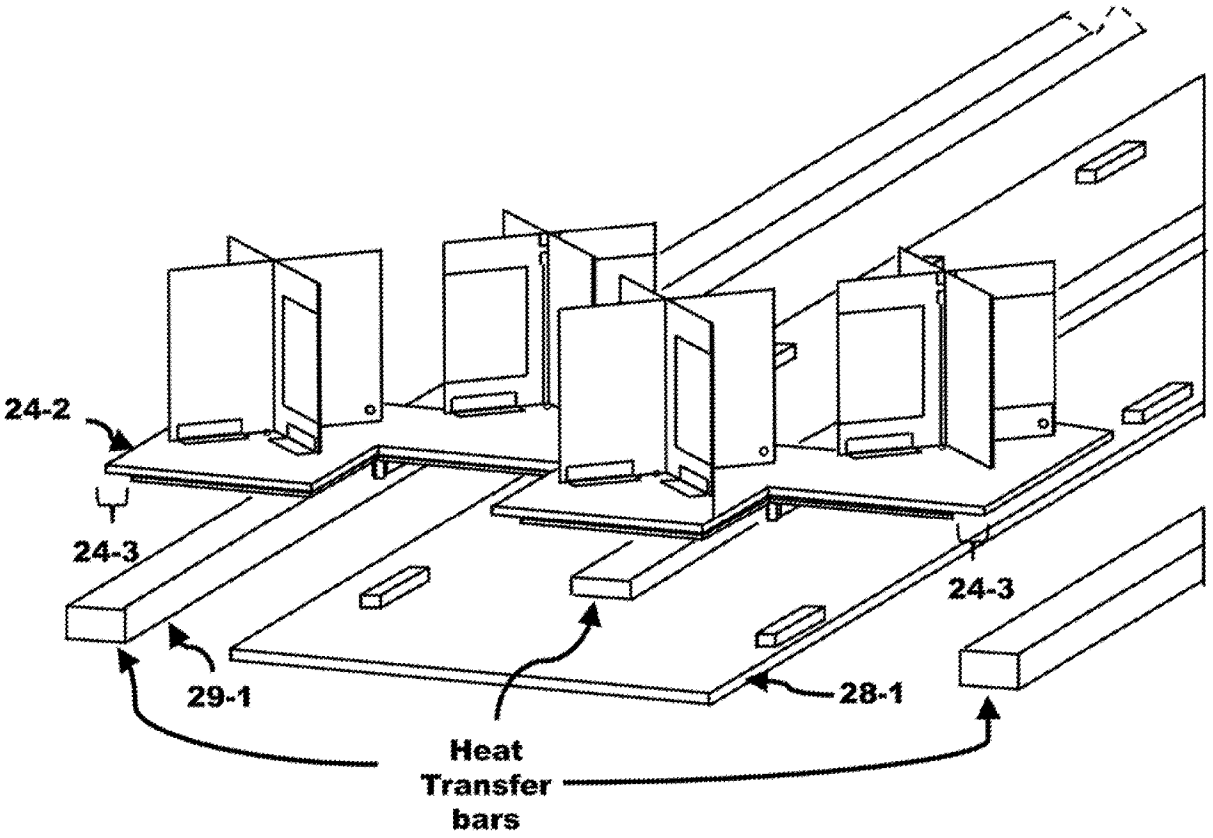
FIG. 29 shows a perspective view of the modules without the module standoffs, master board and heat transfer bars.
Figure 30:
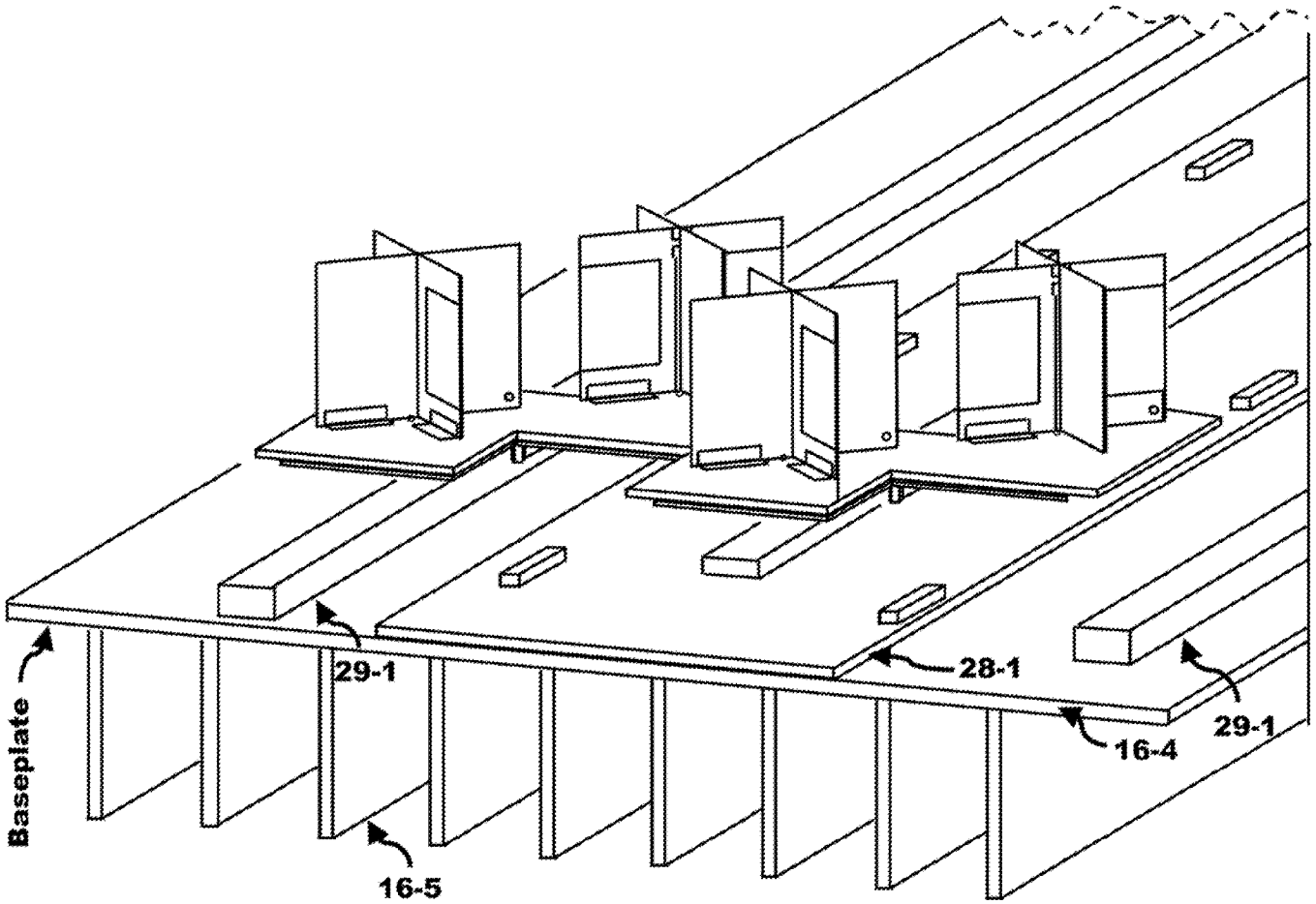
FIG. 30 illustrates a perspective view of the modules without the module standoffs, master board, heat transfer bars, and baseplate with heat fins.
Figure 31:
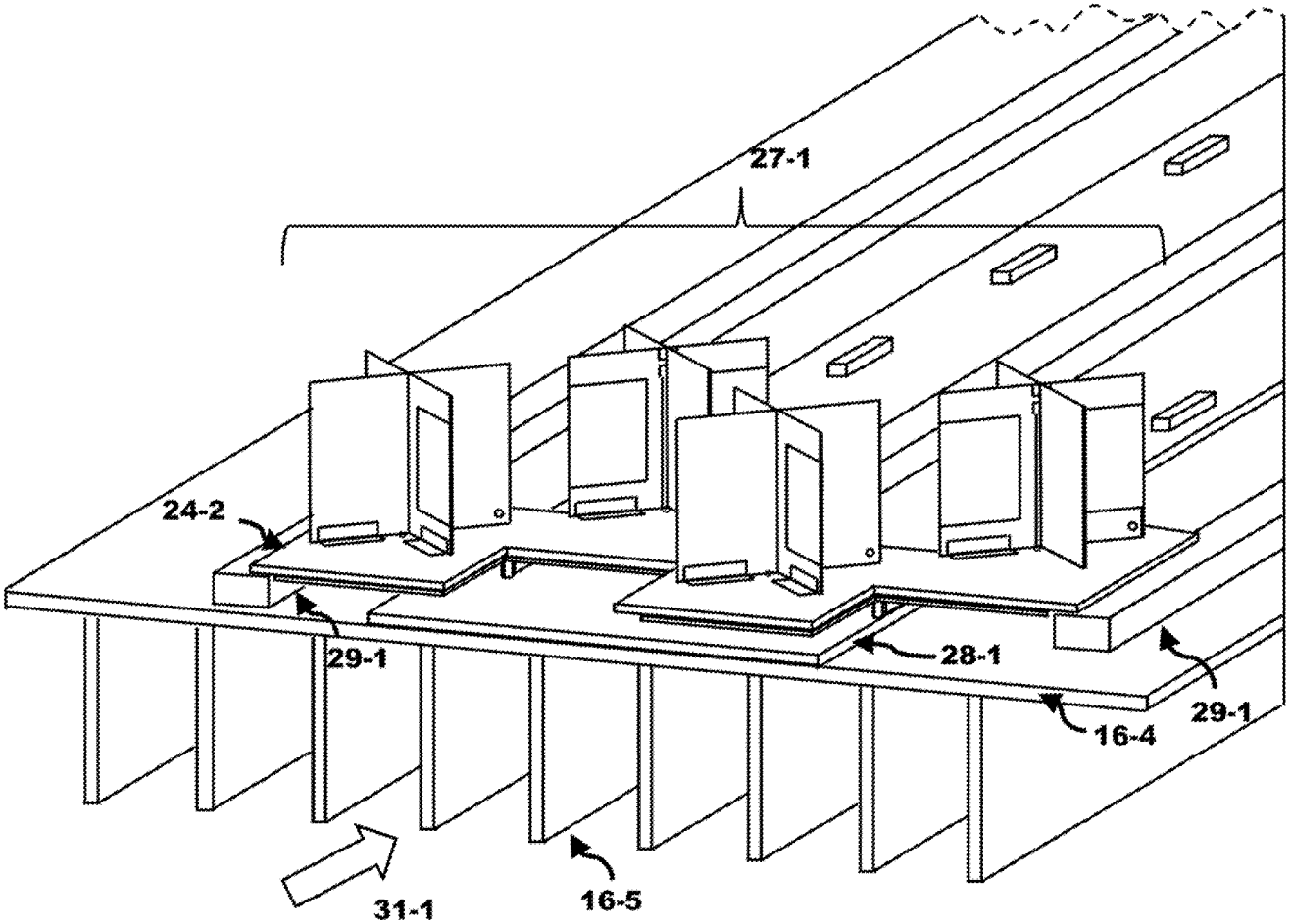
FIG. 31 depicts the modules without the module standoffs, master board, heat transfer bars, and baseplate with heat fins connected together.

FIG. 29 presents a perspective view of the placement of heat transfer bars 29-1 (a.k.a. spacers or standoffs) in relationship to the master board 28-1 and the component module 27-1. The heat transfer bars are metallic and offer a low thermal impedance path for heat from the module metal plate. The top surface of the heat transfer bars are positioned to make a low thermal impedance contact to the metallic surfaces associated with the metal extensions 24-3 of the module metal plates 24-2. FIG. 30 illustrates the master board 28-1 and the heat transfer bars 29-1 secured to the baseplate 16-4. The baseplate in turn connected to the fins 16-5. In FIG. 31, the component module 27-1 is attached (electrically, physically and thermally) to the heat transfer bars 29-1. The heat transfer bars are in turn connected (electrically, physically and thermally) to the baseplate 16-4. The heat fins 16-5 connected to the baseplate provides a large surface area. This large surface area is used to convectively transfer heat from the fins to air between the fins. The heat generated by the electrical components on the module circuit board is transferred to the module metal plate. The heat transfer bars provide a low thermal impedance path between the module metal plates and the baseplate. The component module 27-1 is connected to the heat transfer bars 29-1. The heat transfer bars are designed with a height perpendicular from the baseplate 16-4 to ensure that the cavity formed between the module metal plate 24-2 and the baseplate is sufficiently sized to contain the master board 28-1 and allow for the insertion of the I/O connector 4-2 of each module into the mating interface 11-2 of the master board. The cutout openings 28-3 allows the heat transfer bar 29-1 to pass through the master board 28-1 and make direct contact with the baseplate 16-4 for efficient heat transfer between the module metal plates and the fins.

Each module metal plate 24-2 is attached to the heat transfer bars 29-1 by fasteners (not shown). These fasteners can be screws, nuts and bolts, quick release latches, etc. The fastener attaching the module metal plate to the heat transfer bars insures that both a thermal connection and an electrical connection occur between these two components. The thermal connection transfers heat generated by the electrical components coupled to the module metal plate to the baseplate and fins. The heat transfer bars 29-1, the baseplate 16-4, and the heat fins 16-5 are assembled from individual pieces and can be connected together by fasteners or glue. The electrical connection insures that the metallic structure of the module metal plate and the baseplate are at the same voltage potential. The module metal plate can be coupled to a voltage supply, a ground potential for example, and serves as the ground plane for the antennas that are mounted on the module metal plate. However, the structure of two or more of the heat transfer bars 29-1, the baseplate 16-4, and the heat fins 16-5 can be formed from a single piece of a contiguous metallic component. Forming all three components as one unit would eliminate two interfaces: the heat transfer bar and the baseplate interface; and the baseplate and the heat fin interface. The elimination of one or more interfaces improves the heat transfer and electrical characteristics across these eliminated interfaces. A cross-sectional view along the direction of the arrow 31-1 is presented next.

Figure 32:
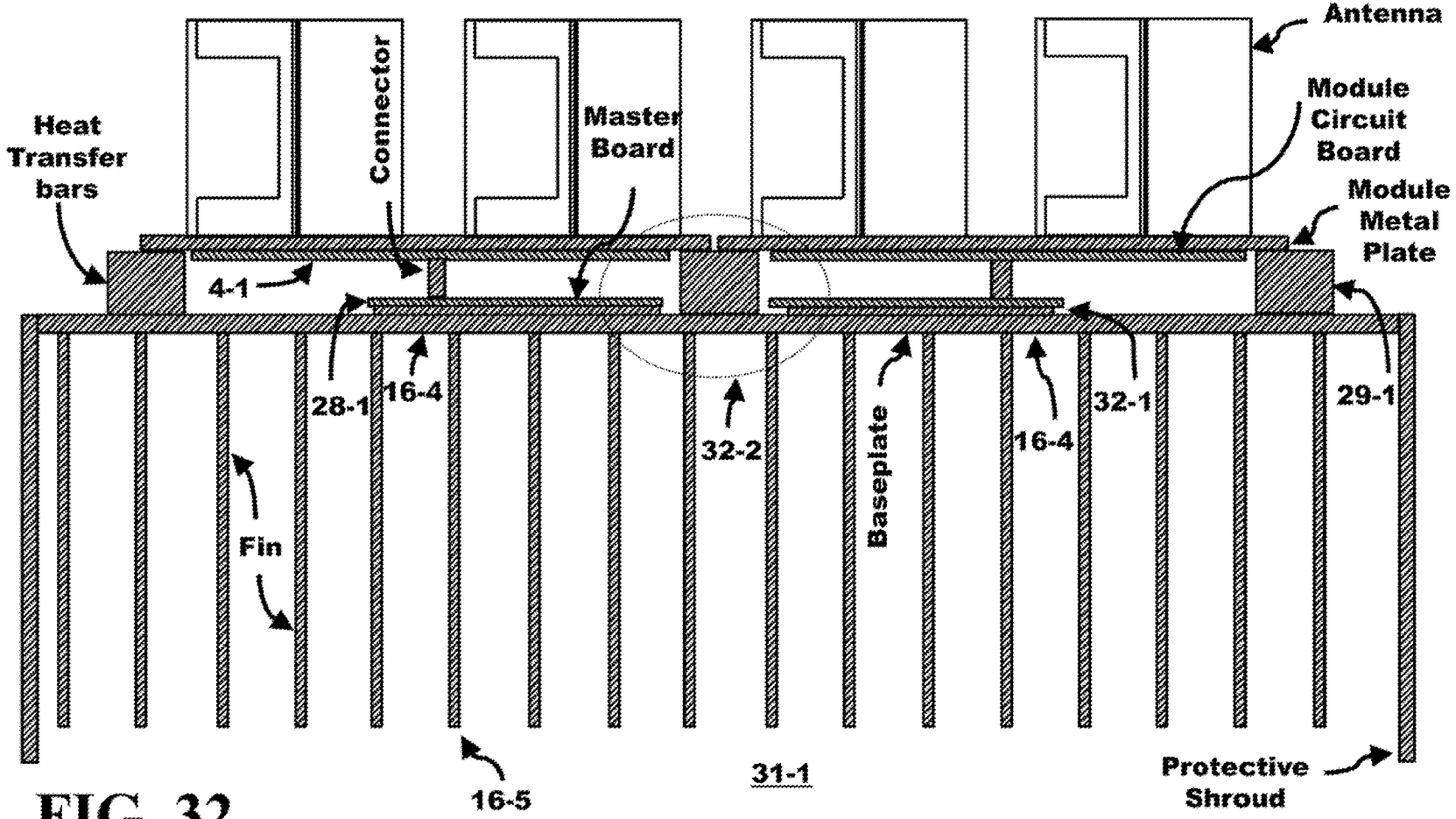
FIG. 32 shows a top view of the phased array.

FIG. 32 illustrates a cross-sectional view 31-1 of an assembled phased array. The antennas are mounted to the module metal plate while the heat transfer bars 29-1 connect the module metal plate to the baseplate 16-4. The module circuit board 4-1 can be connected to the bottom side of the module metal plate via the gasket or other connection methods. Other forms of attaching the circuit board to the metal plate have been mentioned earlier and can include direct contact, glue, or fasteners. The master board 28-1 is thermally and electrically connected to the baseplate by the gasket 32-1 or other similar connection methods as mentioned earlier. The cutout within the master circuit board allows the middle heat transfer bar to thermally and electrically contact the module metal plates to the baseplate. The heat transfer bars also provides a physical structure to connect the module metal plates to the base plate. The module circuit board is electrically connected to the master board by the connector formed by the I/O connector being mated with the mating interface. The outer heat transfer bars 29-3 connect and support the other side of the module metal plate to the baseplate 16-4. The heat transfer bars minimize the thermal impedance for the heat flowing from the module circuit board to the fins that are connected to the baseplate. The baseplate adds further structural support to the phased array and distributes the heat received from the heat transfer bars over the entire baseplate. The distributed heat moves vertically into the baseplate. The heat flows vertically and laterally to the multiple fins 16-5 that are connected to the bottom of the baseplate. The outer protective shroud (if used) protects the outermost fins.

Figure 33:
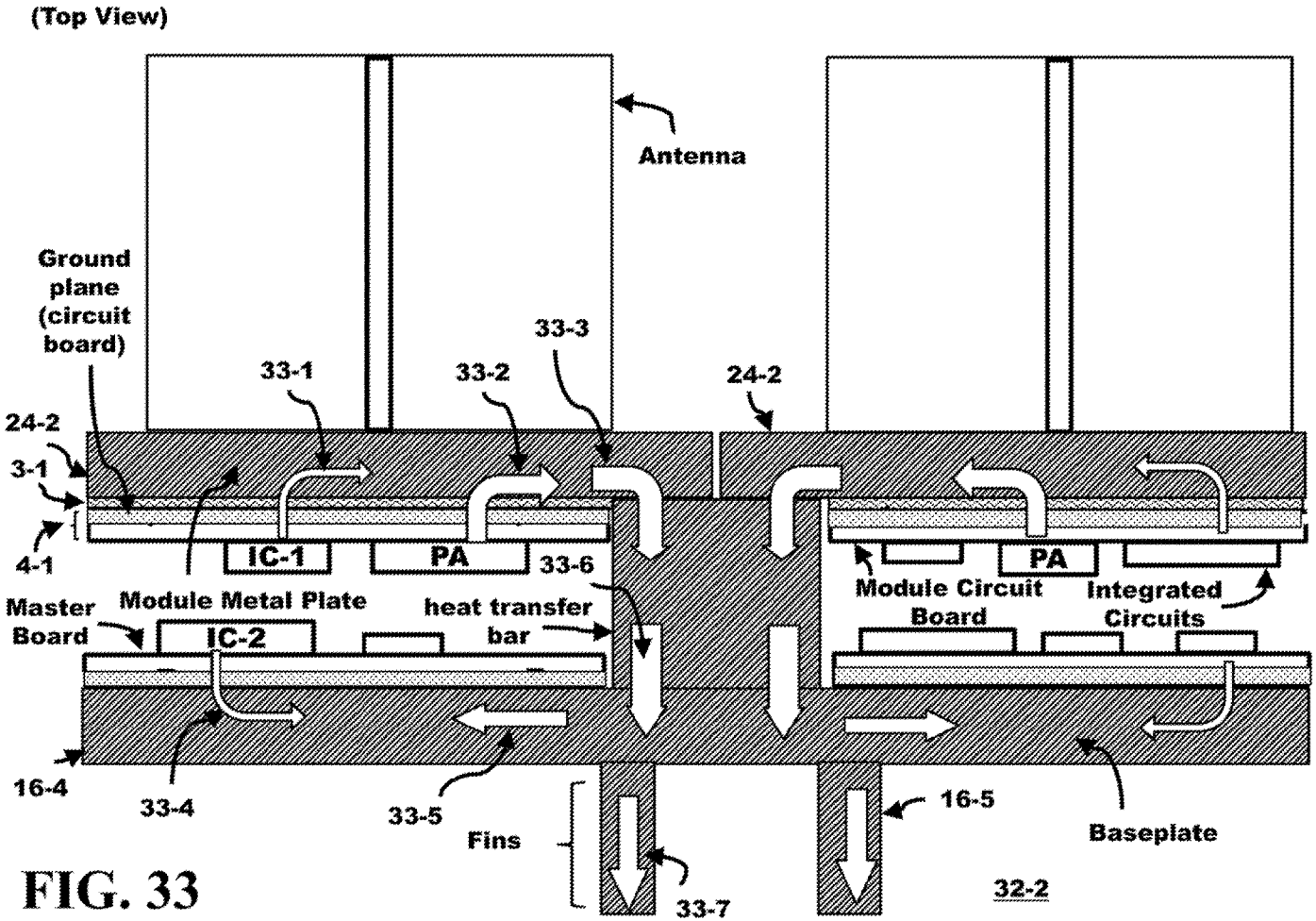
FIG. 33 shows a close-up view of the region 32-1 in FIG. 32.

FIG. 33 illustrates the region 32-2 of FIG. 32 in greater detail indicating the heat flow from the components (integrated circuits, active and passive elements, etc.) mounted on the circuit boards through the various structural components down to the fins 16-5. Only two of the plurality of fins is illustrated. The remaining plurality of fins (not shown) removes heat from the baseplate in a similar manner. The PA dissipates large quantities of heat during normal operation. A single PA can generate 25 W or more of heat. A phased array with 100 antennas each requiring a PA can generate as much as 2500 W. The heat generated by each PA needs to be removed from the phased array through a low thermal impedance path to the outside environment. This is one embodiment that achieves a low thermal impedance. The white arrows indicate the direction of heat flow through the structural components forming the phased array. The thickness of each arrow (if representing the magnitude of heat flow) may not be drawn to scale. Most of the structural components are comprised of metal except for the laminated layers of the PWB board. For example, the heat flow 33-1 and 33-2 from the surface mounted integrated circuit IC-1 and the PA flow perpendicular to the laminated layers within the circuit board 4-1 before reaching the ground plane of the circuit board. The gasket 3-1 insures that the circuit board 4-1 is in good thermal contact across the entire ground plane surface area of the circuit board. The gasket can alternately be replaced with paste, adhesive, or metallic glue, etc. or connected by fasteners (screws, bolts, etc.) to hold the circuit board to the module metal plate. The heat then flows through the low thermal impedance of the electrical insulating gasket 3-1 (if used) to the module metal plate 24-2.

The laminated layers of the PWB typically offer high thermal impedance to the heat flow. This large thermal impedance can be reduced if the area of the PA package is increased to help spread out the heat over this larger area. In addition, the actual layout of the PA circuitry within the integrated circuit can also be redesigned and laid out over a larger surface area of the semiconductor. The heat generated by the power-consuming amplifier stage of the PA would then be spread out over a larger area within the semiconductor which would further help to reduce the thermal impedance of the laminated layers of the PWB between the packaged device and the module metal plate.

The module metal plate 24-2 channels the heat flow 33-3 to the heat transfer bar which transfers the heat 33-6 to the baseplate 16-4. Most of the heat captured by the heat transfer bar is transferred to the baseplate as indicated by the heat flow 33-6 via the heat transfer bar (see FIG. 33). The bottom surfaces of the metal extensions 24-3 of all the module metal plates are substantially in contact to the top surfaces of the heat transfer bars. The bottom surfaces of the outer heat transfer bars are in contact to the top surface of the baseplate. However, the bottom surface of one or more of the middle heat transfer bars can have at least one location where a notch is formed along the bottom surface of the heat transfer bar. This notch in the heat transfer bar is sized to allow the unobscured placement of at least one selected PWB between the two outer heat transfer bars. This distribution board can be one of the selected PWBs. This selected PWB allows a plurality of the master boards within the phase array to be connected together via a single distribution board.

The integrated circuit packages on the master board transfer their heat perpendicular through the PWB to the baseplate 16-4. For example, the heat flow 33-4 of integrated circuit IC-2 flows through the circuit board of the master board to the baseplate 16-4. The exposed metal layer of the master board can be in direct contact with the baseplate. A gasket may not be required since the heat generated by the master board is much less that of the module circuit board comprising the PAs. The heat flow 33-6 from the heat transfer bar divides into the heat flow 33-5 and the heat flow 33-7. The beat flow 33-5 shows the lateral heat flow from the heat transfer bar carried by the baseplate and moving toward the remaining fins 16-5 (not illustrated).

One embodiment of the phased array uses aluminum as the metal forming the structural components: module metal plate; heat transfer bars; baseplate; fins; and protective shroud to reduce costs and weight. Although other metals are suitable as alternative embodiments of the subject matter of the disclosure. Examples of metals with large thermal conductivity include but are not limited to copper, silver, zinc, nickel, iron, etc. For example, metal alloys can be used in the construction of the system. The thickness of the metal components is about 3000 □m to amply carry the heat, offer structural integrity, minimize cost, and minimize the weight of the phased array. Thicknesses more than 3000 □m can be used if the weight is not an issue, while thicknesses less than 3000 □m offer less weight at increased thermal resistance. Furthermore, the type of metal used and the thicknesses used for each metal component can be independently chosen and adjusted, respectively, as alternative embodiments of the subject matter of the disclosure to achieve a phased array that achieves a desired cost, weight, heat extraction, and strength for the unit.

Figures 34A, 34B:
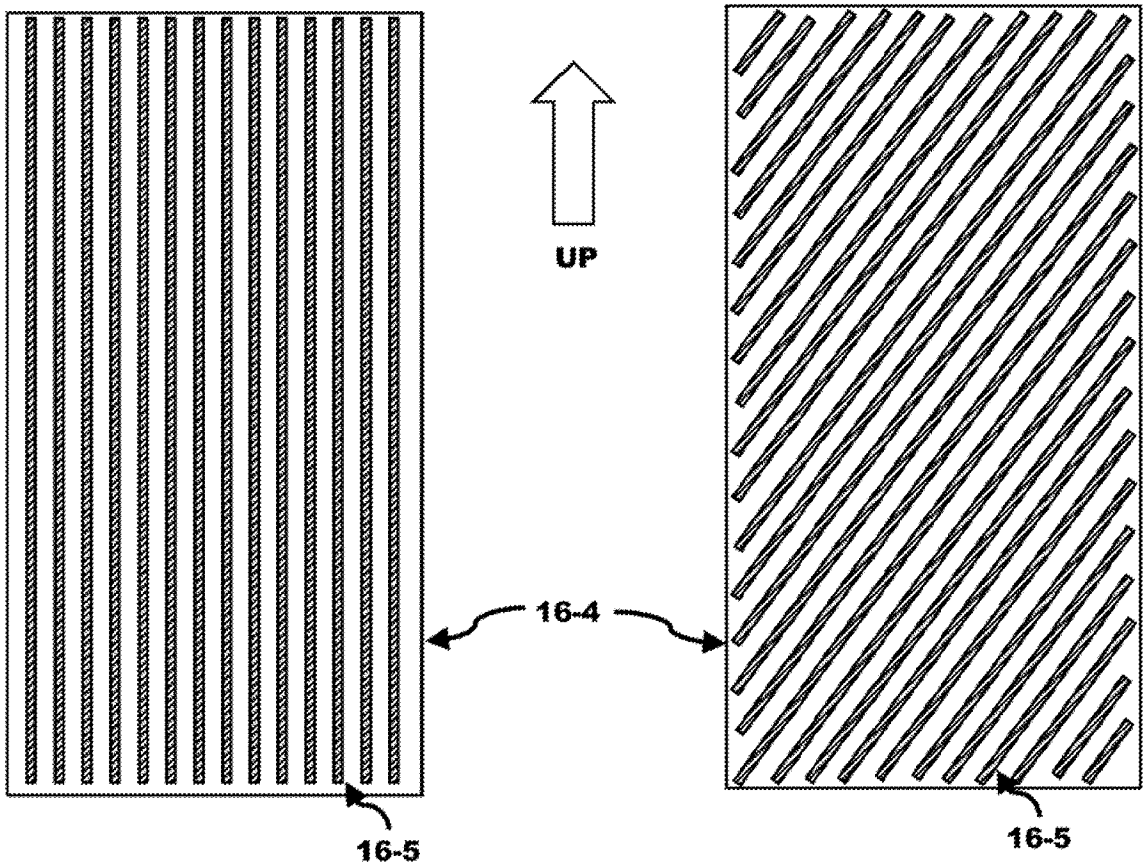
FIG. 34A shows a back view of the phased array illustrating vertical fins.
FIG. 34B depicts a back view of the phased array illustrating fins set off at an angle to provide an improved heat transfer to the ambient environment.

FIG. 34A illustrates a back view of an assembled phased array illustrating an embodiment showing the fins 16-5 connected to the baseplate 16-4 in a vertical orientation as indicated by the vertical arrow. Heat from the phase array is transferred to the vertical fins. As the fins heat up, the air between the fins heat up and flow upwards. The air then exits the top of the phase array and carries the heat away into the ambient atmosphere. Fresh air enters from the bottom and continuously carries the heat from the phase array. FIG. 34B illustrates a back view of an assembled phased array illustrating another embodiment where the orientation of the fins 16-5 connected to the baseplate 16-4 with respect to the vertical arrow are rotated at an angle from the vertical. The fins 16-5 can be tilted at any one of a plurality of angles from the vertical. Heat from the phase array is transferred to the fins that are tilted at an angle. As the fins heat up, the air between the fins heat up and cause the air flow between fins to make more contact with the fins thereby improving the heat exchange between the fins and the air. The air being heated moves upwards and to the right exiting the right side of the phase array and carries the heat away into the ambient atmosphere. Fresh cooler air is drawn from the left side of the phase array between the fins to continue the process of heat removal. The heated air exiting from the right side eliminates the heat generated by the phase array.

Figure 35:
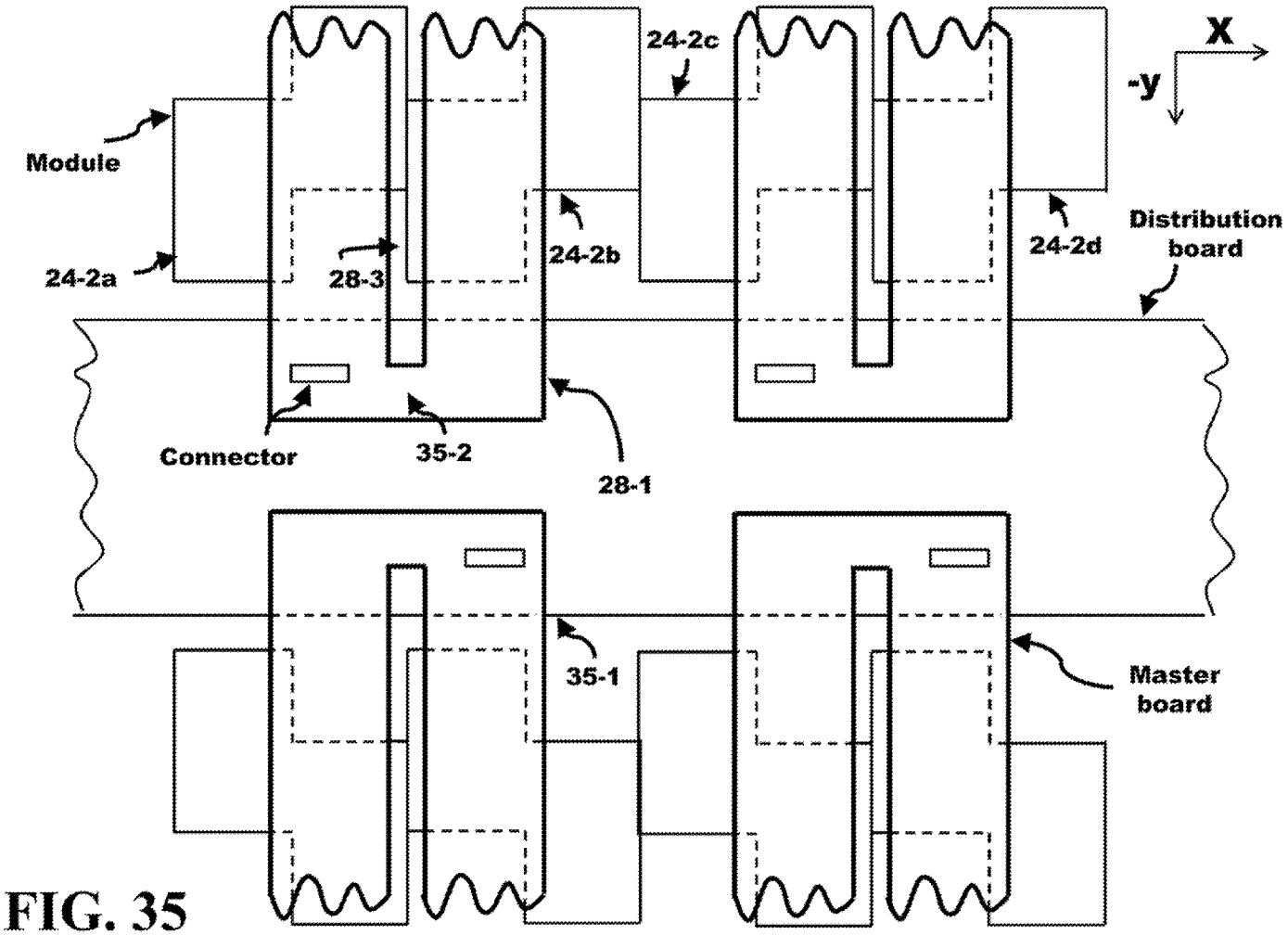
FIG. 35 shows a bottom view in the middle of the phased array where the partitioned master boards are connected to the distribution board.

FIG. 35 depicts a bottom view of the phase array showing the modules, master board, and distribution board. Four module outlines 24-2*a*, 24-2*b*, 24-2*c*, and 24-2*d* are illustrated along the top. Each module is connected to the master board by a connector (not shown). The master board 28-1 has on opening 28-3 and a connector coupling the master board to the distribution board 35-1. The master boards 28-1 is separated into two long circuit board sections by the opening 28-3 but are connected together as a single unit by the common portion of the circuit board 35-2. The electrical characteristics of the traces formed on either long circuit board would be similar since the board is fabricated as a single unit at the same time. The two modules 24-2*a* and 24-2*b* forms one instant of the component module 24-1. A second instant of the component module 24-1 is formed by modules 24-2*c* and 24-2*d*. The module is shaped to fit together when placed side-by-side. Note that the phased array can be increased in size in the positive/negative Y direction by adding more modules in each column and correspondingly extending the master board upwards/downwards, respectively. Similarly, if desired, the phased array can be increased in the X direction by adding more columns of modules and extending the master board to the right/left and including additional cutouts in the master board.

Figure 36:
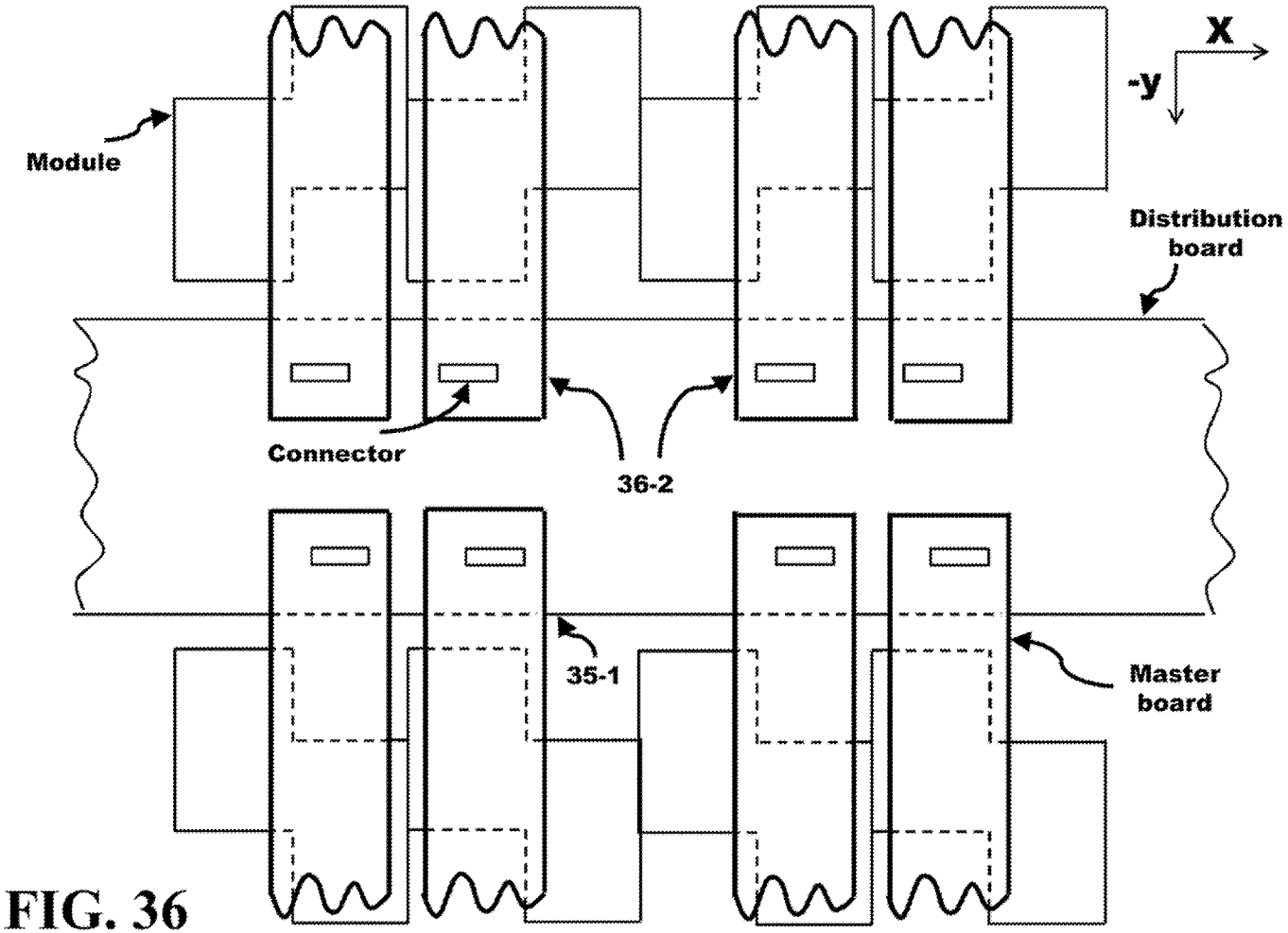
FIG. 36 depicts a bottom view in the middle of the phased array of another embodiment where the partitioned master boards are connected to the distribution board.

FIG. 36 presents the master boards 36-2 where the common portion of the circuit board 35-2 has been eliminated. The circuit board can be connected by a common portion at the far end (not shown). In this case, the electrical characteristics of the traces formed on either long circuit board would be similar since the board is fabricated as a single unit. However, another embodiment would allow for four separate master boards along the top of the distribution board 35-1 and four separate master boards along the bottom of the distribution board. Each master board in this case would be connected to the distribution board by its own connector.

Although it is not illustrated, the phased array of FIG. 32 can be covered with a radome. The radome is a shield that allows the passage of RF energy while acting as a barrier to weather conditions in the exterior environment. The radome is attached to the baseplate forming a sealed volume containing the antennas, the module metal plate and the heat transfer bars. Cavities can be formed within the phase array and these cavities can be filled with most of the remaining electronics necessary to operate the phased array. Thus, the electronics within the phased array is in the sealed volume of the phased array. The sealed volume within the radome protects all of the electronics from the harsh weather conditions but also forms a sealed container. The sealed volume prevents effectively using convection heat to exchange the heat generated by the enclosed electronics with the external environment. The heat generated by the electronics within this sealed section is instead removed by the use of the conductive heat flow formed by the metallic structural components of the phased array. The metallic structural components can be constructed as individual pieces, these individual pieces can held together by gluing, welding, riveting, swaging, or by the use of nut and bolts. Swaging is a slot-peg system that press fits two pieces together where the peg and slot are mated together and press fitted together. The completed construction of the metallic structural components forms a metallic skeleton that transfers heat from the electrical components to the exterior fins of the phased array. In another embodiment, some or all of the metallic structural components can be constructed as single contiguous unit in the system; thereby eliminating metal to metal interfaces. Metal to metal interfaces may not form a uniform contact along their entire surface area. This can cause the formation of islands of air gaps at the interface. These air gaps reduce the heat flow across the interface. Removing these metal to metal interfaces removes the air gaps and improves the heat transfer within the system.

Heat pipes could also be mounted to the metallic supports to carry the heat generated by the PAs and electronic components of the phased array. The heat pipes absorb heat from the metallic supports which vaporizes a liquid in a sealed container and condenses back into a liquid at the other end of the sealed container releasing heat in the process. The heat pipe could, for example, contact the module metal plate 24-2 within the sealed portion of the system. The other end of the sealed container of the heat pipe can be extended outside of the sealed system to release the heat into the ambient environment. The heat pipe would offer a high thermal conductivity path between any internal points of the sealed system to any external point within the ambient environment.

Heat pipes could also be mounted to the side of the baseplate 16-4 that is attached to the fins 16-5. The heat pipe would help the lateral conduction of heat along the baseplate. The heat pipe can also be in direct contact with the fins (a slot in the fins to fit the heat pipe) and the baseplate simultaneously. The heat from the baseplate can more readily spread laterally and to the fins at the same time. Such a heat pipe configuration can be used to extend the width of the baseplate to emit heat over a larger area. The heat pipe would offer a high thermal conductivity path between any two external points of the system within the ambient environment.

Other embodiments are within the following claims. For example, any power dissipative integrated circuit components such as microprocessors, DSP, can utilized the Module Ground Plate technique to channel heat away from the components mounts on the PWB. In addition, a network and a portable system can exchange information wirelessly by using communication techniques such as Time Division Multiple Access (TDMA), Frequency Division Multiple Access (FDMA), Code Division Multiple Access (CDMA), Orthogonal Frequency Division Multiplexing (OFDM), Ultra Wide Band (UWB), Wi-Fi, WiGig, Bluetooth, etc. The communication network can comprise the phone network, IP (Internet protocol) network, Local Area Network (LAN), ad hoc networks, local routers and even other portable systems.

What is claimed is:

1. An antenna system comprising:

a plurality of antenna modules;

a thermally conductive support plate; and a master board on the support plate, said master board including signal paths for routing signals to the plurality of antenna modules and including a plurality of I/O connectors, wherein the plurality of antenna modules are electrically connected to the master board, and wherein each antenna module of the plurality of antenna modules comprises:

a thermally conductive base plate with front and back sides;

a plurality of thermally conductive standoffs;

an antenna element arranged on and extending away from the front side of the base plate;

a circuit board with front and back sides and including a ground plane on the back side of the circuit board, said ground plane of the circuit board next to and in thermal contact with the back side of the base plate;

a plurality of electrical components mounted on the circuit board, said plurality of electrical components including an I/O connector that mates with a corresponding I/O connector of the plurality of I/O connectors on the master board to electrically connect the circuit board to the master board; and a power amplifier in thermal contact with the base plate, said power amplifier for driving the antenna element with a transmit signal, wherein the plurality of thermally conductive standoffs of each antenna module of the plurality of antenna modules thermally connect the base plate of that antenna module to the support plate.

2. The antenna system of claim 1, wherein the power amplifier is mounted directly on the base plate.

3. The antenna system of claim 1, wherein the power amplifier is mounted on the circuit board.

4. The antenna system of claim 1, wherein the plurality of antenna modules are identical to each other.

5. The antenna system of claim 1, wherein each antenna module of the plurality of antenna modules comprises a plurality of antennas.

6. The antenna system of claim 1, wherein the support plate and the base plates of the plurality of antenna modules are made of metal.

7. The antenna system of claim 1, wherein the master board has a plurality of holes through which the plurality of standoffs pass to thereby thermally connect the base plates of the plurality of antenna modules to the support plate.

8. The antenna system of claim 1, wherein the master board includes only passive electrical components.

9. The antenna system of claim 1, further comprising an RF transparent radome covering and protecting the plurality of antenna modules and the master board.

10. The antenna system of claim 1, further comprising a heat sink assembly thermally connected to the support plate, said heat sink assembly for dissipating heat generated by the circuit boards within the plurality of antenna modules.

11. The antenna system of claim 10, wherein the heat sink assembly comprises a plurality of metal fins for convectively dissipating heat.

12. The antenna system of claim 1, wherein the signal paths on the master board are for routing IF and local oscillator signals to the circuit boards in each antenna module of the plurality of antenna modules.

13. The antenna system of claim 1, wherein the circuit board in each antenna module of the plurality of antenna modules is a printed wire board.

14. The antenna system of claim 1, wherein the master board is a printed wire board.

15. An antenna system comprising:

an antenna module comprising:

a thermally conductive base plate with front and back sides;

a plurality of thermally conductive standoffs;

an antenna element arranged on and extending away from the front side of the base plate;

a circuit board with front and back sides and including a ground plane on the back side of the circuit board, said ground plane of the circuit board next to and in thermal contact with the back side of the base plate;

a plurality of electrical components mounted on the circuit board, said plurality of electrical components including an I/O connector; and a power amplifier in thermal contact with the base plate, said power amplifier for driving the antenna element with a transmit signal, said antenna system further comprising:

a thermally conductive support plate with front and back sides, the front side of the support plate separated from, parallel to, and facing the front side of the base plate, and wherein the circuit board is located between the base plate and the support plate; and a master board including an I/O connector mating with the I/O connector on the circuit board and electrically connecting the circuit board to the master board, said master board located between the circuit board and the front side of the support plate, said master board including signal paths for routing signals to the circuit board, and wherein the plurality of thermally conductive standoffs thermally connect the base plate to the support plate.

16. The antenna system of claim 15, wherein the power amplifier is mounted directly on the base plate.

17. The antenna system of claim 15, wherein the power amplifier is mounted on the circuit board.

18. The antenna system of claim 15, wherein the base plate and the support plate are made of metal.

19. The antenna system of claim 15, further comprising a heat sink assembly thermally connected to the support plate, said heat sink assembly for dissipating heat generated by the circuit board.

20. The antenna system of claim 19, wherein the heat sink assembly comprises a plurality of metal fins for convectively dissipating heat.

21. The antenna system of claim 15, wherein the master board has a plurality of holes through which the plurality of standoffs pass to thereby thermally connect the base plate to the support plate.

22. The antenna system of claim 15, further comprising a heat conducting material sandwiched between the back surface of the circuit board and the back surface of the base plate.

23. The antenna system of claim 22, wherein the heat conducting material is a thermally conductive gasket.

24. The antenna system of claim 15, wherein the signal paths on the master board are for routing IF and local oscillator signals to the circuit board.

25. The antenna system of claim 15, further comprising an RF transparent radome covering and protecting the antenna module and the master board.

26. The antenna system of claim 15, wherein the master board includes only passive electrical components.

27. The antenna system of claim 15, wherein the master board is mounted on the support plate.

28. The antenna system of claim 15, wherein the circuit board is a printed wire board.

29. The antenna system of claim 15, wherein the master board is a printed wire board.

* * * * *